US005294529A

United States Patent [19]

Idogaki et al.

[11] Patent Number: 5,294,529

[45] Date of Patent: * Mar. 15, 1994

[54] SILVER HALIDE COLOR PHOTOGRAPHIC MATERIAL CONTAINING MAGENTA COUPLER, IMAGE-DYE STABILIZER AND HIGH BOILING COUPLER SOLVENT

[75] Inventors: Yoko Idogaki; Osamu Takahashi, both of Minami-ashigara, Japan

[73] Assignee: Fuji Photo Film Co., Ltd., Kanagawa, Japan

[ * ] Notice: The portion of the term of this patent subsequent to Jun. 9, 2009 has been disclaimed.

[21] Appl. No.: 875,607

[22] Filed: Apr. 28, 1992

Related U.S. Application Data

[63] Continuation of Ser. No. 603,005, Oct. 25, 1990, abandoned.

[30] Foreign Application Priority Data

Oct. 30, 1989 [JP] Japan ..... 64-282314

[51] Int. Cl.[5] ..... G03C 7/388; G03C 7/38

[52] U.S. Cl. ..... 430/546; 430/551; 430/558

[58] Field of Search ..... 430/558, 551, 546

[56] References Cited

U.S. PATENT DOCUMENTS

| | | | |
|---|---|---|---|
| 3,700,455 | 10/1972 | Ishikawa et al. | 430/554 |
| 4,203,716 | 5/1980 | Chen | 430/545 |
| 4,639,413 | 1/1987 | Kawagishi et al. | 430/546 |
| 4,857,449 | 8/1989 | Ogawa et al. | 430/546 |
| 4,865,963 | 9/1989 | Furutachi et al. | 430/558 |
| 4,906,559 | 3/1990 | Nishijima et al. | 430/558 |
| 5,120,636 | 6/1992 | Takahashi et al. | 430/551 |

FOREIGN PATENT DOCUMENTS

| | | | |
|---|---|---|---|
| 0276319 | 8/1988 | European Pat. Off. | 430/546 |
| 0355660 | 2/1990 | European Pat. Off. | 430/551 |

*Primary Examiner*—Lee C. Wright

*Attorney, Agent, or Firm*—Birch, Stewart, Kolasch & Birch

[57] ABSTRACT

There is disclosed a silver halide color photographic material having at least one silver halide emulsion layer on a base, which comprises in the silver halide emulsion layer a magenta coupler, an image-dye stabilizer, and a high-boiling organic solvent of which the weight ratio to the coupler is 3.0 or over. The disclosure as described provides a color photographic material being excellent in color reproduction and having improved light-fastness of magenta color image with good balance from high density part to low density part.

22 Claims, No Drawings

SILVER HALIDE COLOR PHOTOGRAPHIC MATERIAL CONTAINING MAGENTA COUPLER, IMAGE-DYE STABILIZER AND HIGH BOILING COUPLER SOLVENT

This application is a continuation of application Ser. No. 07/603,005 filed on Oct. 25, 1990, now abandoned.

FIELD OF THE INVENTION

The present invention relates to silver halide color photographic materials, and in particular to a silver halide color photographic material improved in color reproducibility, discoloration and fading of the dye image by light.

BACKGROUND OF THE INVENTION

As silver halide color photographic materials, ones containing three color couplers that will couple with the oxidized product of an aromatic primary amine color-developing agent to form respectively yellow, magenta, and cyan are most common.

Of these, as magenta couplers, pyrazolotriazole magenta couplers described, for example, in U.S. Pat. No. 3,725,067 are preferable in view of color reproduction, because they form azomethine dyes, which are not great in harmful subsidiary absorption near 430 nm, and they are also preferable because they are low in the formation of yellow stain in the color-unformed part that will be caused by heat and humidity.

However, the azomethine dye formed from such magenta couplers has a problem in that its fastness to light is low.

As techniques for improving the light resistance of the above pyrazoloazole magenta couplers, improved techniques using spiroindane compounds described, for example, in JP-A ("JP-A" means unexamined published Japanese patent application) No. 118141/1974, phenol compounds or phenol ether compounds described, for example, U.S. Pat. No. 4,588,679 and JP-A Nos. 262159/1985 and 282845/1986, metal chelate compounds described in JP-A NO. 97353/1985, silyl ether compounds described in JP-A No. 164743/1985, and hydroxycumarone compounds described in JP-A No. 177454/1986 were found, and these are effective to a certain level, yet they are not satisfactory.

According to prior techniques, including the above techniques, an adequately improved effect, enough particularly to satisfy light fastness of color-formed dye images simultaneously in the high-density region and the low-density region, could not be obtained, and a technique for improving light fastness of color-formed dye images over the whole region from the high-density part to the low-density part in a balanced manner has been sought.

SUMMARY OF THE INVENTION

The object of the present invention is to provide a silver halide color photographic material excellent in color reproducibility and remarkably improved in light fastness of the magenta color image from the high-density part to the low-density part.

Other and further objects, features and advantages of the invention will appear more evident from the following description.

DETAILED DESCRIPTION OF THE INVENTION

The object of the invention has been attained by the following technique:

(1) A silver halide color photographic material having at least one silver halide emulsion layer on a base, characterized in that said silver halide emulsion layer contains at least one magenta coupler represented by the following formula (I):

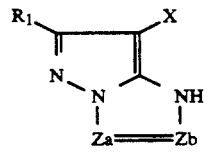

Formula (I)

wherein Za and Zb each represent

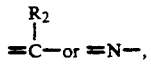

$R_1$ and $R_2$ each represent a hydrogen atom or a substituent, X represents a hydrogen atom or a group or an atom capable of being released upon the coupling reaction with the oxidized product of an aromatic primary amine developing-agent, when Za and Zb together form a carbon-carbon double bond, Za and Zb may be part of the aromatic ring, and the compound may form a dimer or higher polymer through $R_1$, $R_2$, or X, at least one compound represented by the following formula (II):

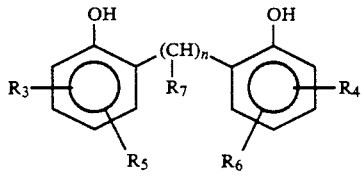

Formula (II)

wherein $R_3$, $R_4$, $R_5$ and $R_6$ each represent an alkyl group having 1 to 18 carbon atoms, $R_7$ represents a hydrogen atom or an alkyl group having 1 to 12 carbon atoms, n is an integer of 1 to 3, and when n is 2 to 3, groups $R_7$ may be the same or different, and when n is 1, $R_7$ represents the above-mentioned alkyl group, and a high-boiling coupler solvent incompatible with water, and the weight ratio of said high-boiling coupler solvent to the coupler is 3.0 or over.

(2) A silver halide color photographic material as defined in (1), characterized in that said silver halide emulsion layer contains at least one homopolymer or copolymer insoluble in water.

The magenta couplers represented by formula (I) used in the present invention will now be described.

The pyrazoloazole magenta couplers represented by formula (I) are magenta couplers known, for example, in U.S. Pat. Nos. 4,735,893, 4,769,313, 4,857,444, 4,500,630, 4,540,654, 4,621,046, and 3,061,432.

Of the pyrazoloazole magenta couplers represented by formula (I), preferable ones are those represented by the following formulae (Ia) and (Ib):

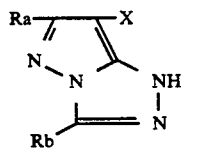

Formula (Ia)

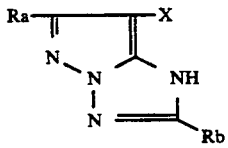

Formula (Ib)

In formulae (I), (Ia), and (Ib), $R_1$(Ra) and $R_2$(Rb), which may be the same or different, each represent specifically a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group, with particular preference given to an alkyl group, an alkoxy group, an alkylthio group, an aryl group, an aryloxy group, an arylthio group, an acylamino group, or an anilino group. The total number of carbon atoms of the above-mentioned groups each is 50 or below. X represents a hydrogen atom, a halogen atom (e.g., chlorine, bromine, and iodine), a carboxyl group, a group that bonds to the carbon atom through an oxygen atom (e.g., acetoxy, propanoyloxy, benzoyloxy, 2,4-dichlorobenzoyloxy, ethoxyoxazaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenetyloxy, 2-phenoxyethoxy, 5-phenyltetrazolyloxy, and 2-bonzothiazolyloxy), a group that bonds to the carbon atom through a nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazole-1-yl, 5- or 6-bromo-benzotriazole-1-yl, 5-methyl-1,2,3,4-triazole-1-yl, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivaloylaminophenylazo, and 2-hydroxy-4-propanoylphenylazo), and a group that bonds to the carbon atom through a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5,-tetrazolylthio, 2-benzothiazolylthio, 2-dodecylthio-5-thiophenylthio, and 2-phenyl-3-dodecyl-1,2,4-triazolyl-5-thio), and $R_1$(Ra), $R_2$(Rb), or X may be a bivalent group to form a bis-compound.

The couplers may be in the form of polymer couplers, wherein the coupler residue represented by formula (I), (Ia), or (Ib) is present in the main chain or on the side chain of the polymer, and particularly it is preferable to use a polymer coupler derived from a vinyl monomer having a moiety represented by formula (I), (Ia), or (Ib), in which $R_1$(Ra), $R_2$(Rb), or X represent a vinyl group or a linking group.

When those represented by formulae (I), (Ia), and (Ib) are contained in a vinyl group, specific examples of the linking group represented by $R_1$(Ra), $R_2$(Rb), or X include groups formed by combining those selected from an alkylene group (e.g., a substituted or unsubstituted alkylene group, such as methylene, ethylene, 1,10-decylene, and —$CH_2CH_2OCH_2CH_2$—), a substituted or unsubstituted phenylene group (e.g., 1,4-phenylene, 1,3-phenylene,

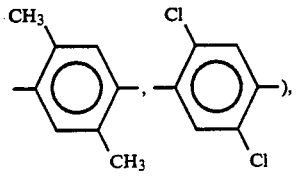

—NHCO—, —CONH—, —O—, —OCO—, and an aralkylene group (e.g.,

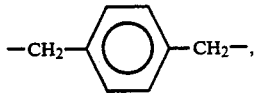

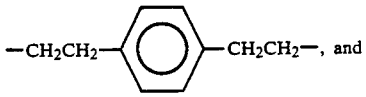

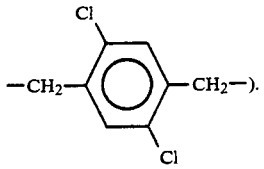

As preferable linking groups, —NHCO—, —$CH_2CH_2$—,

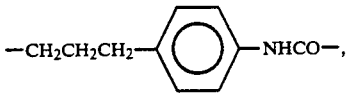

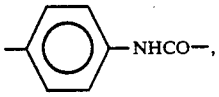

—$CH_2CH_2NHCO$—,

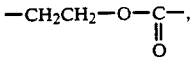

—CONH—$CH_2CH_2$NHCO—, —$CH_2CH_2$O—$CH_2CH_2$—NHCO—, and

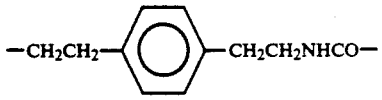

can be mentioned.

The coupler represented by formula (I) of the present invention can be used generally in the range of $1\times10^{-2}$ to 1 mol, preferably $1\times10^{-1}$ to $5\times10^{-1}$ mol, per mol of the silver halide. If desired, the coupler of the present invention can be used together with other types of magenta coupler.

Typical specific examples of the magenta coupler represented by formula (I) of the present invention are listed below;

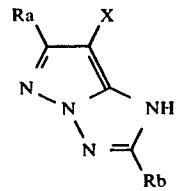
| Compound | Ra | Rb | X |
|---|---|---|---|
| I-1 | $CH_3$— | 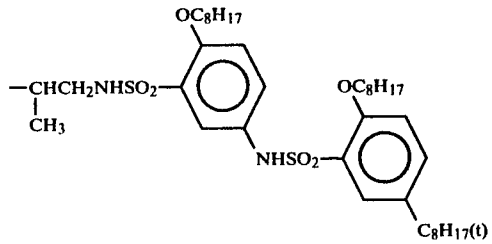 | Cl |
| I-2 | The same as the above | 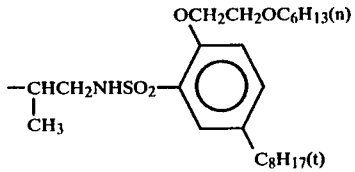 | The same as the above |
| I-3 | $(CH_3)_3C$— | 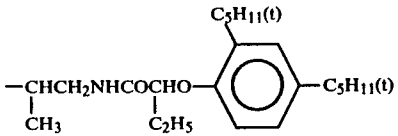 | 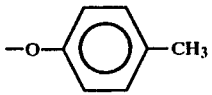 |
| I-4 | 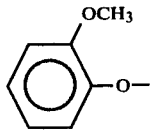 | 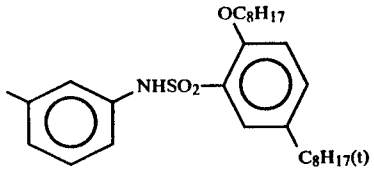 | 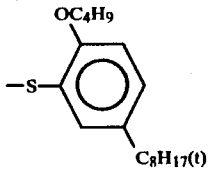 |

-continued
| Compound | Ra | Rb | X |
|---|---|---|---|
| I-5 | $CH_3$— | 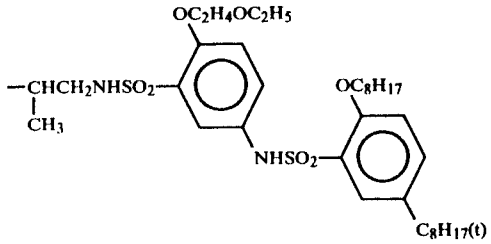 | Cl |
| I-6 | The same as the above | 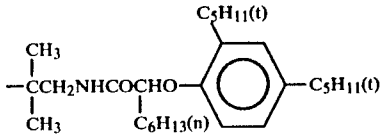 | The same as the above |
| I-7 | The same as the above | 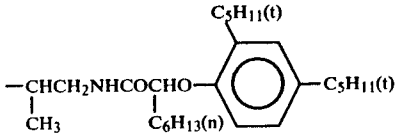 | The same as the above |
| I-8 | The same as the above | 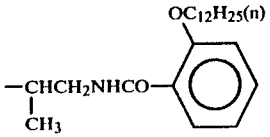 | The same as the above |
| I-9 | The same as the above | 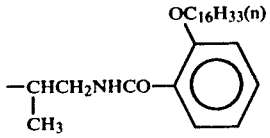 | The same as the above |

-continued
| Compound | Ra | Rb | X |
|---|---|---|---|
| I-10 | 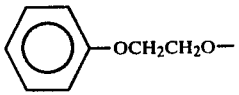 | 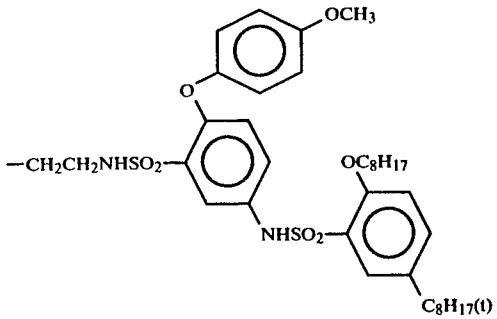 | 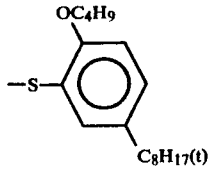 |
| I-11 | $CH_3CH_2O-$ | The same as the above | The same as the above |
| I-12 | 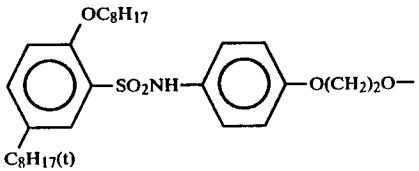 | 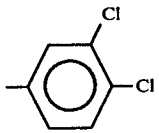 | 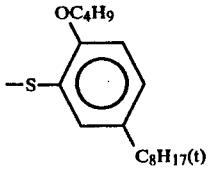 |
| I-13 | 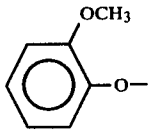 | 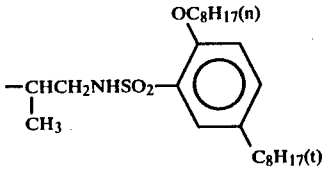 | Cl |
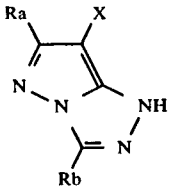
| | | | |
|---|---|---|---|
| I-14 | $CH_3-$ | 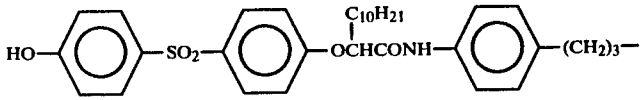 | Cl |

-continued

| Compound | Ra | Rb | X |
|---|---|---|---|
| I-15 | The same as the above | $(n)C_6H_{13}$ <br> $CHCH_2SO_2-(CH_2)_2-$ <br> $(n)C_8H_{17}$ | The same as the above |
| I-16 | $CH_3$ <br> $CH-$ <br> $CH_3$ | $OC_4H_9$ <br> $-SO_2-(CH_2)_3-$ <br> $C_8H_{17}(t)$ | The same as the above |
| I-17 | $CH_3$ <br> $+CH-CH_2)_{50}+CH_2-C)_{50}-$ <br> $COOCH_2CH_2OCH_3$ $CONH-$ | $CH_3-CH-$ <br> $CH_2NHSO_2CH_3$ | The same as the above |
| I-18 | $-O-$ | $OC_8H_{17}$ <br> $+CH_2)_2NHSO_2-$ <br> $C_8H_{17}(t)$ | The same as the above |
| I-19 | $CH_3-$ | $CH_3$ <br> $CH_3$ <br> $CH_3$ $NHCOCHO-$ <br> $(n)C_{10}H_{21}$ <br> $-SO_2-$ <br> $-OCH_2-$ | Cl |
| I-20 | $(CH_3)_3C-$ | $CH_3$ <br> $CH_3$ $C_5H_{11}(t)$ <br> $CH_3$ $NHCOCHO-$ $-C_5H_{11}(t)$ <br> $C_4H_9(n)$ | The same as the above |

-continued
| Compound | Ra | Rb | X |
|---|---|---|---|
| I-21 | 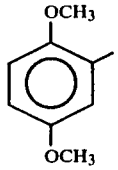 | 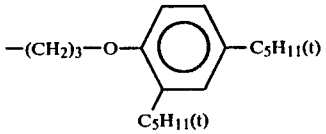 | The same as the above |
| I-22 | $CH_3$— | $(n)C_{18}H_{37}$<br>\|<br>—CH—$NCOCH_2CH_2COOH$<br>\|<br>$C_2H_5$ | The same as the above |

The compound represented by formula (II) will now be described in detail.

The alkyl group represented by $R_3$, $R_4$, $R_5$, $R_6$, and $R_7$ includes substituted and unsubstituted alkyl groups and straight-chain, branched chain, and cyclic alkyl groups. Substituents of the substituted alkyl groups are those listed as substituents in the above description of the coupler. The alkyl group represented by $R_3$, $R_4$, $R_5$, $R_6$, and $R_7$ is preferably an unsubstituted alkyl group. The total number of carbon atoms of $R_3$ to $R_7$ is 6 or over, preferably 32 or over, and $R_7$ is preferably an alkyl group having 3 to 12 carbon atoms, more preferably 3 to 5 carbon atoms. More preferably, $R_3$ and $R_4$ each are a methyl group.

The compound represented by formula (II) of the present invention is added in an amount of 1 to 100 mol %, preferably 1 to 30 mol %, for the coupler of the present invention. Preferably the compound is co-emulsified with the magenta coupler.

Specific examples of the compound represented by formula (II) used in the present invention are given below, but the present invention is not limited to them.

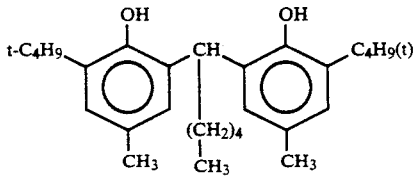
(II-1)

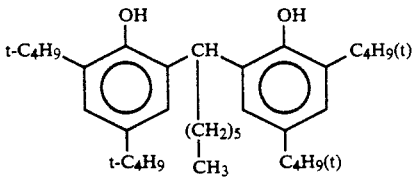
(II-2)

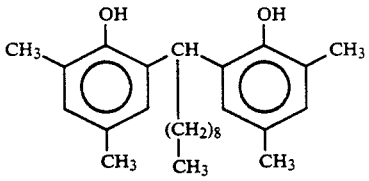
(II-3)

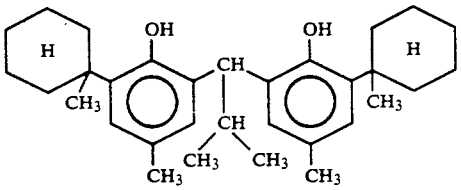
(II-4)

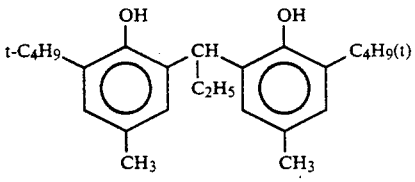
(II-5)

-continued

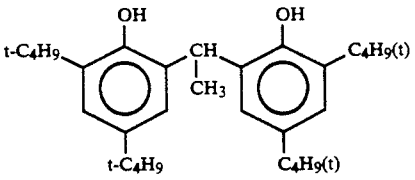
(II-6)

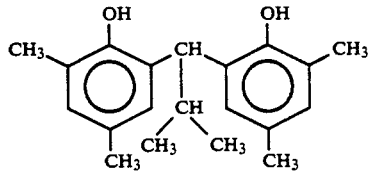
(II-7)

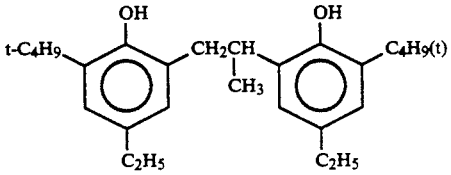
(II-8)

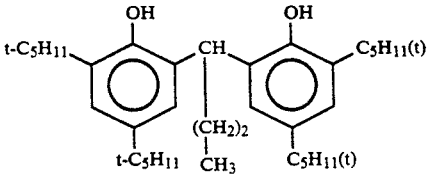
(II-9)

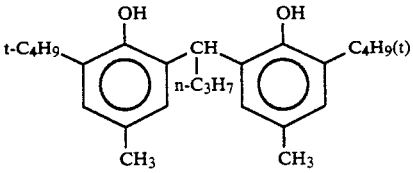
(II-10)

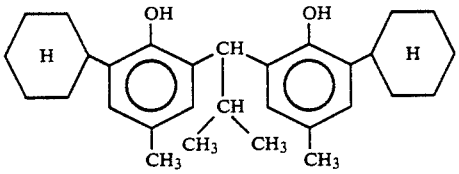
(II-11)

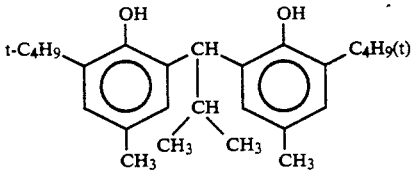
(II-12)

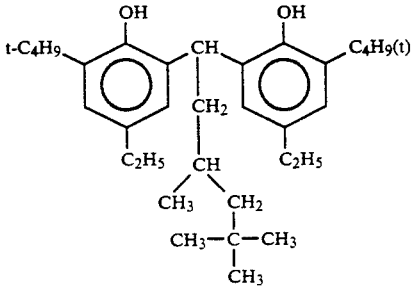
(II-13)

-continued (II-14)

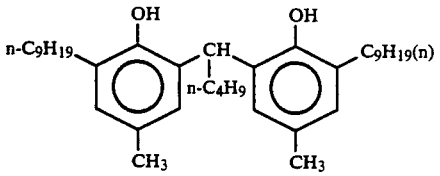

(II-15)

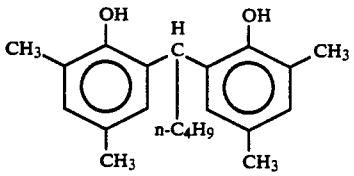

(II-16)

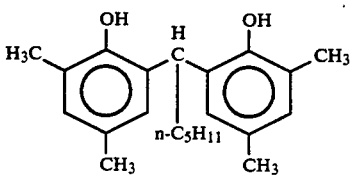

(II-17)

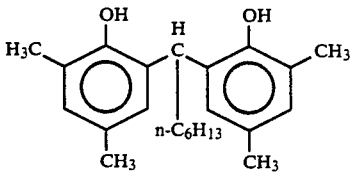

(II-18)

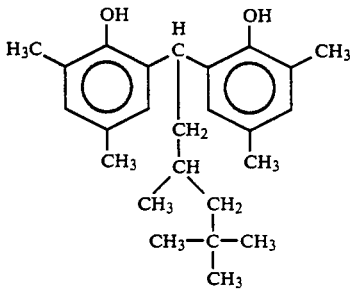

Next, the high-boiling solvent for coupler to be used in the present invention will be described.

In this specification and claims, "the high-boiling solvent for coupler" means a solvent for coupler having a boiling point of 140° C. or over and being immiscible with water. The boiling point of the high-boiling solvent for coupler is preferably 160° C. or over, more preferably 170° C. or over, and the melting point of the high-boiling solvent for coupler is preferably 100° C. or below, more preferably 80° C. or below. Although the ratio of the high-boiling solvent for coupler to the magenta-coupler in a green-sensitive silver halide emulsion layer was conventionally about 2.0 or below, use of this ratio 3.0 or over is one of the features of the present invention.

As the high-boiling solvent for coupler to be used in the present invention, one represented by the following formula (III), (IV), (V), (VI), or (VII) is preferably used. The high-boiling solvent for coupler of the present invention has preferably a boiling point of 160° C. or over.

Formula (III)

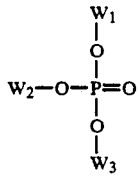

Formula (IV)

$$W_1—COO—W_2$$

Formula (V)

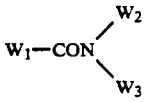

Formula (VI)

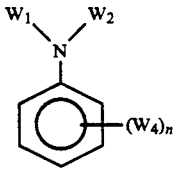

Formula (VII)

$$W_1—O—W_2$$

wherein $W_1$, $W_2$, and $W_3$ each represent a substituted or unsubstituted alkyl group having preferably 4 to 20 carbon atoms, more preferably 6 to 20 carbon atoms, cycloalkyl group having preferably 4 to 20 carbon atoms, more preferably 6 to 20 carbon atoms, alkenyl group having preferably 4 to 20 carbon atoms, more preferably 6 to 20 carbon atoms, aryl group having preferably 6 to 20 carbon atoms, phenyl group having preferably 6 to 20 carbon atoms (e.g., phenyl, methylphenyl) or heterocyclic group having preferably 4 to 20 carbon atoms, $W_4$ represents $W_1$, O—$W_1$ or S—$W_1$, n is an integer of 1 to 5, when n is 2 or over, $W_4$ groups may be the same or different, and in formula (VII), $W_1$ and $W_2$ may together form a condensed ring. $W_1$, $W_2$, $W_3$, and $W_4$ each preferably represent an alkyl group, a cycloalkyl, or an aryl group, in particular.

Of compounds represented by formulae (III) to (VII), one represented by formula (III), (IV), or (V) is preferable.

Specific examples of the high-boiling solvent for coupler to be used in the present invention are shown below, but the invention is not limited to them.

$$O{=}P(OC_4H_9\text{-}n)_3 \quad \text{(S-1)}$$

$$O{=}P(OCH_2CH_2CH(CH_3)CH_3)_3 \quad \text{(S-2)}$$

$$O{=}P(OC_6H_{13}\text{-}\underline{n})_3 \quad \text{(S-3)}$$

(S-4)

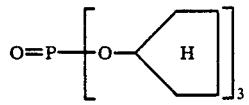

(S-5)

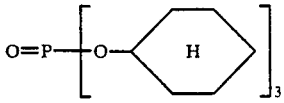

$$O{=}P(OC_8H_{17}\text{-}\underline{n})_3 \quad \text{(S-6)}$$

-continued
(S-7)
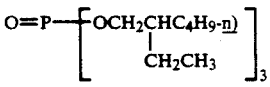
(S-8)
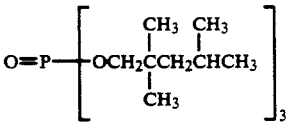
(S-9)
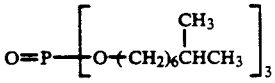
(S-10)
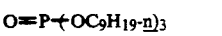
(S-11)
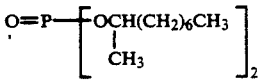
(S-12)
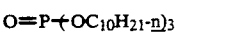
(S-13)
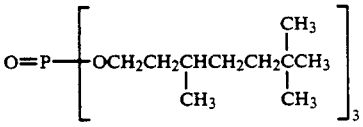
(S-14)
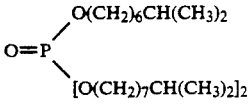
(S-15)
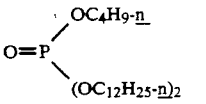
(S-16)
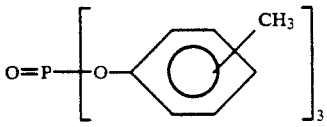
(S-17)
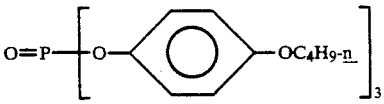
(S-18)
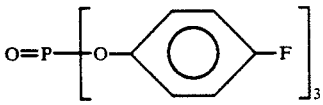
(S-19)
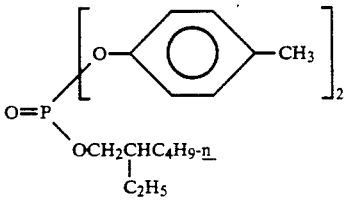
(S-20)
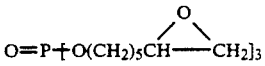
-continued
(S-21)
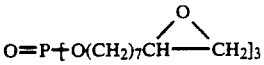
(S-22)
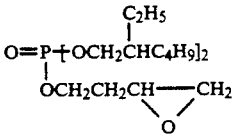
(S-23)
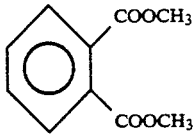
(S-24)
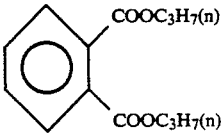
(S-25)
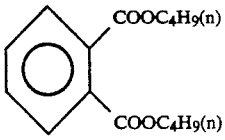
(S-26)
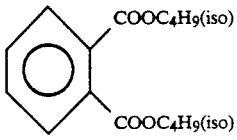
(S-27)
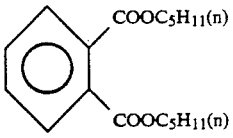
(S-28)
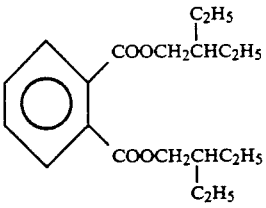
(S-29)
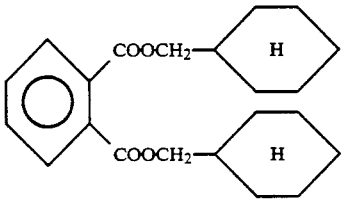
(S-30)
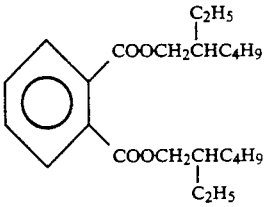

-continued
(S-31)
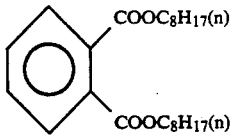
(S-32)
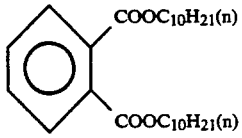
(S-33)
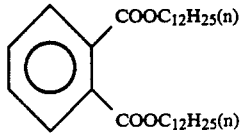
(S-34)
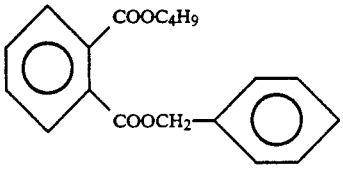
(S-35)
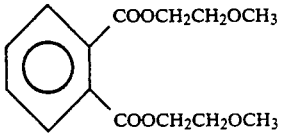
(S-36)
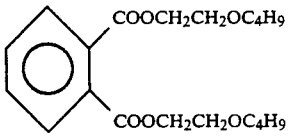
(S-37)
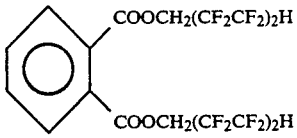
(S-38)
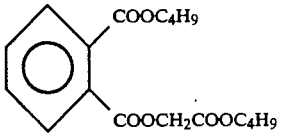
(S-39)
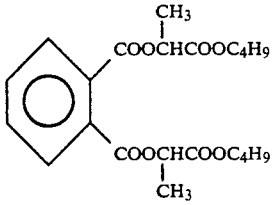
-continued
(S-40)
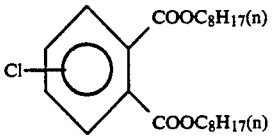
(S-41)
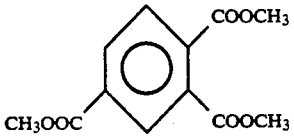
(S-42)
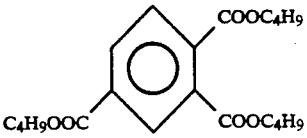
(S-43)
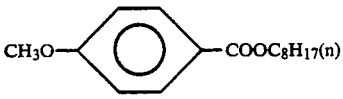
(S-44)
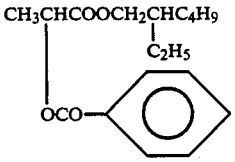
(S-45)
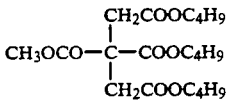
(S-46)
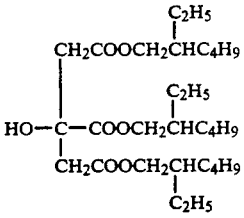
(S-47)
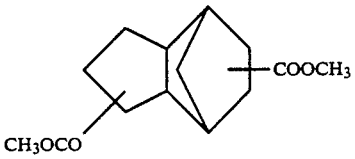
(S-48)
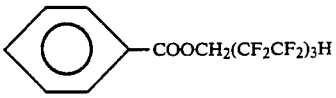
(S-49)
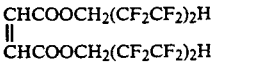

-continued
(S-50)
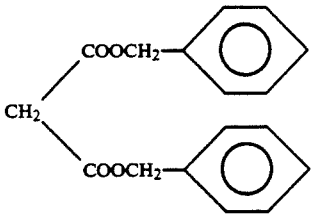
(S-51)
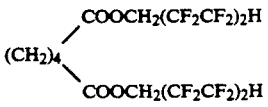
(S-52)
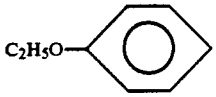
(S-53)
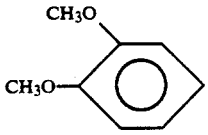
(S-54)
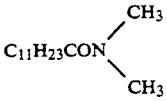
(S-55) $C_{12}H_{25}OH$
(S-56) $C_{16}H_{33}OH$
(S-57) $C_{18}H_{27}OH$
(S-58) $C_{10}H_{21}O(CH_2)_5O(CH_2)_2OH$
(S-59)
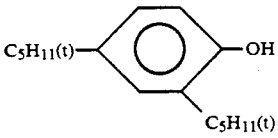
(S-60)
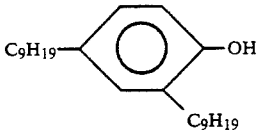
(S-61) $CH_3(CH_2)_{17}Cl$
(S-62) $CH_3(CH_2)_{15}Br$
(S-63)
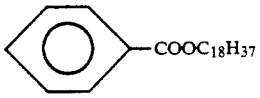
(S-64)
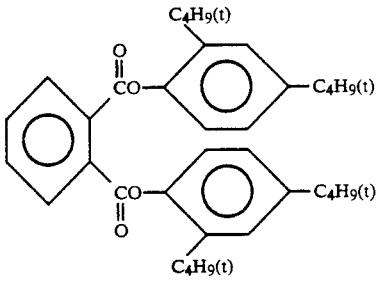
-continued
(S-65)
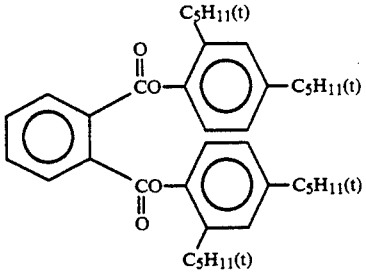
(S-66)
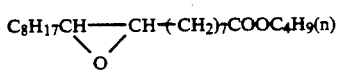
(S-67)
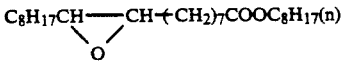
(S-68)
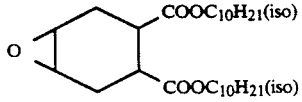
(S-69)
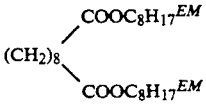
(S-70)
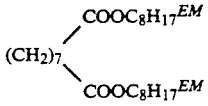
Note: $-C_8H_{17}^{EM} = -CH_2CHC_4H_9(n)$ ($C_2H_5$)
(S-71)
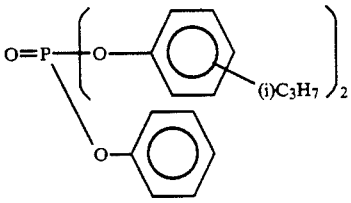
(S-72)
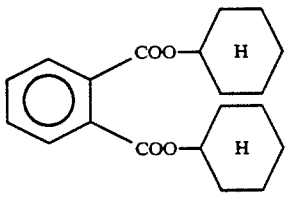
(S-73)
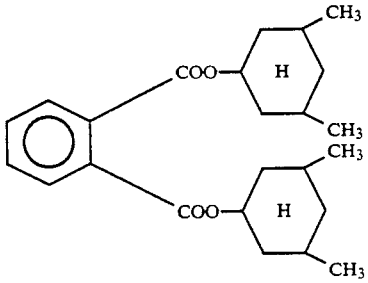

-continued (S-74)

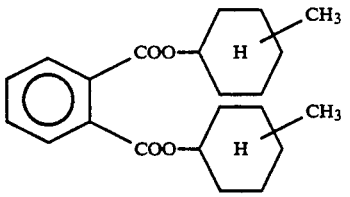

In the present invention, the high-boiling coupler solvent is used in a weight ratio of 3.0 or over, preferably from 3.5 to 10, and particularly preferably from 3.5 to 5.0, to the coupler represented by formula (I) of the present invention.

When the high-boiling point coupler solvent/coupler weight ratio has been made 3.0 or over, the light fastness of the coupler of formula (I) has been improved greatly, and particularly the light fastness in the high-density part has been remarkably improved.

Preferably, the coupler represented by formula (I) according to the present invention is dissolved, if necessary, together with an organic co-solvent (e.g., a low-boiling organic solvent such as ethyl acetate), in the high-boiling coupler solvent, the solution is emulsified and dispersed into an aqueous gelatin solution with stirring, and the emulsified dispersion is mixed with a silver halide emulsion, so that the mixture may be incorporated into the coating liquid for the silver halide emulsion layer.

Herein by "organic co-solvent" is meant an organic solvent that is useful for emulsification and dispersion and that can eventually be removed substantially from the photographic material at the drying step after coating or by the above method, such as a low-boiling organic solvent, or a solvent that has a certain solubility in water and that can be washed away with water or the like.

As the organic co-solvent, acetates of lower alcohols, such as ethyl acetate and butyl acetate, ethyl propionate, secondary butyl alcohol, methyl ethyl ketone, methyl isobutyl ketone, β-ethoxyethyl acetate, methyl Cellosolve acetate, methyl Carbitol acetate, methyl Carbitol propionate, cyclohexane, and diethyl carbonate can be mentioned.

Further, if necessary, an organic solvent completely miscible with water, such as methyl alcohol, ethyl alcohol, acetone, and tetrahydrofuran, can additionally be used to some extent.

A combination of two or more of these organic solvents can also be used.

In the present invention, although the compound represented by formula (II) may be emulsified separately from the above coupler by using a high-boiling organic solvent, preferably the compound is coemulsified with the above coupler by using the high-boiling coupler solvent.

In the present invention, together with the compound of formula (II) of the present invention, various photographic hydrophobic substances may be incorporated.

As the photographic hydrophobic substances, colored couplers, non-dye-forming couplers, developing-agents, developing-agent precursors, development inhibitor precursors, ultraviolet absorbers, development accelerators, gradation adjusters such as hydroquinone, dyes, dye releasers, antioxidants, brightening agents, anti-fading agents, and image stabilizers can be mentioned.

Further, in the present invention, preferably the silver halide emulsion layer containing the coupler represented by formula (I) further contains at least one water-insoluble homopolymer or copolymer, particularly because the light fastness in the low-density part is further improved.

To add the polymer, for example, the above polymer may be made into latex particles previously and the latex is added to the emulsion layer, or the above polymer may be dissolved completely into an organic co-solvent together with the high-boiling coupler solvent and the coupler, and then the solution is dispersed.

Although the polymer used in the present invention may be any polymer if the polymer is insoluble in water, preferably the polymer has good compatibility with the coupler and the dye that will be formed. It is more preferable to use a polymer whose repeating units have

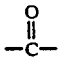

bonds, and particularly preferably, an acrylate polymer or methacrylate polymer.

Specific examples of the polymer of the present invention will now be listed and described, but the present invention is not limited to them.

(A) VINYL POLYMERS

As monomers that will form the vinyl polymer of the present invention, can be mentioned acrylates, specifically, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, diemthylaminoethyl acrylate, benzyl acrylate, methoxybenzyl acrylate, 2-chlorocyclohexyl acrylate, cyclohexyl acrylate, furfuryl acrylate, tetrahydrofrufuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, -methoxypolyethylene glycol acrylate (the adduct number=9), 1-bromo-2-methoxyethyl acrylate, and 1,1-dichloro-2-ethoxyethyl acrylate.

And the monomers described below can be used.

Methacrylates, for example, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (the adduct number=6), allyl methacrylate, and methacrylic acid dimethylaminoethylmethyl chloride salt;

vinyl esters: for example, vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate;

acrylamides: for example, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxyethyl) acrylamide, and diacetone acrylamide;

methacrylamides: for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide, and N-(2-acetoacetoxyethyl) methacrylamide;

olefins: for example, dicyclopentadiene, ethylene, propylene, 1-butene, 1-pentene, vinyl chloride, vinylidene chloride, isoprene, chloroprene, butadiene, and 2,3-dimethylbutadiene; styrenes such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and vinyl benzoic acid methyl ester;

vinyl ethers: for example, methyl vinyl ether, butyl vinyl ether, hexyl vinyl ether, methoxy vinyl ether, and dimethylaminoethyl vinyl ether; and others: for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, and vinylidene.

With respect to the monomers used for the polymer of the present invention (e.g., the above-mentioned monomers), two or more monomers can be used as comonomers in relation to each other in accordance with various purposes (e.g., in order to improve the solubility). In order to adjust the color forming properties and the solubility, monomers having an acid group exemplified below as comonomers can be used in the range wherein the copolymer will not become insoluble in water:

acrylic acid; methacrylic acid; itaconic acid; maleic acid; monoalkyl itaconates such as monomethyl itaconate, monoethyl itaconate, and monobutyl itaconate; monoalkyl maleates such as monomethyl itaconate, monoethyl itaconate, and monobutyl itaconate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid, and acryloyloxypropylsulfonic acid; methacryloyloxyalkylsulfonic acids such as methacryloyloxymethylsulfonic acid, methacryloyloxyethylsulfonic acid, and methacryloyloxypropylsulfonic acid; acrylamidoalkylsulfonic acids such as 2-acrylamido-2-methylethanesulfonic acid, 2-acrylamido-2-methylpropanesulfonic acid, and 2-acrylamido-2-methylbutanesulfonic acid; and methacrylamidoalkylsulfonic acids such as 2-methacrylamido-2-methylethanesulfonic acid, 2-methacrylamido-2-methylpropanesulfonic acid, and 2-methacrylamido-2-methylbutanesulfonic acid.

These acids may be in the form of salts of an alkali metal (e.g., Na and K) or ammonium ion(s).

When, from among the vinyl monomers mentioned above and other vinyl monomers used in the present invention, hydrophilic monomers (herein by "hydrophilic monomers" is meant monomers that the polymer obtained by homopolymerization of the monomer is soluble in water) are used as comonomers, there is no limit on the proportion of the hydrophilic monomer in the copolymer, unless the copolymer becomes insoluble in water, but generally the proportion of the hydrophilic monomer in the copolymer is preferably 40 mol % or below, more preferably 20% or below, and further more preferably 10 mol % or below. Further, if the hydrophilic comonomer that will be copolymerized with the monomer of the present invention has an acid group, the proportion of the comonomer having an acid group in the copolymer is generally 20 mol % or below, preferably 10 mol % or below, and most preferably nil, in view of the image stability as stated above.

The essential monomer used in the synthesis of the polymer of the present invention is preferably an acrylate monomer, a methacrylate monomer, an acrylamide monomer, or a methacrylamide monomer, with particular preference given to an acrylate monomer or a methacrylate monomer.

(B) POLYESTER RESINS OBTAINED BY CONDENSING POLYHYDRIC ALCOHOLS AND POLYBASIC ACIDS

As polyhydric alcohols, glycols having the structure of HO—$R_1$—OH (wherein $R_1$ represents a hydrocarbon chain, particularly an aliphatic hydrocarbon chain, having about 2 to about 12 carbon atoms) or polyalkylene glycols are effective, and as polybasic acids, HOOC—$R_2$—COOH (wherein $R_2$ represents simply a bond or a hydrocarbon chain having 1 to about 12 carbon atoms) is effective.

As specific examples of the polyhydric alcohols, can be mentioned ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythrite, mannitol, and sorbitol.

As specific examples of the polybasic acids, can be mentioned oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, fumaric acid, maleic acid, itaconic acid, citraconic acid, phthalic acid, isophthalic acid, terephthalic acid, tetrachlorophthalic acid, itaconic acid, isopimelic acid, cyclopentadiene/maleic anhydride adduct, and rosin/maleic anhydride adduct.

(C) OTHERS

For example, a polyester obtained by ring opening polymerization as follows:

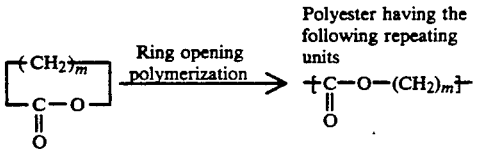

wherein m is an integer of 4 to 7, and the group —$CH_2$— may be branched.

Suitable monomers that can be used for producing the above polyester include, for example, β-propiolactone, ε-caprolactone, and dimethylpropiolactone.

Two or more of the polymers of the present invention described above may be combined suitably.

Although the molecular weight and the degree of the polymerization of the polymers of the present invention do not influence substantially the effect of the present invention, preferably the molecular weight is 20,000 to 5,000,000.

Preferably the weight ratio of the polymer of the present invention to the coupler of formula (I) is from 0.01 to 6, more preferably from 0.05 to 3. The weight ratio of the polymer of the present invention to the high-boiling coupler solvent in the same layer is preferably 0.001 to 2, more preferably 0.01 to 1.

Some specific examples of the polymer used in the present invention are given below, but the present invention is not limited to them.

| Specific example | Polymer species |
|---|---|
| P-1) | poly(vinyl acetate) |
| P-2) | poly(vinyl propionate) |
| P-3) | poly(methyl methacrylate) |
| P-4) | polyethylene methacrylate |
| P-5) | polyethylene acrylate |
| P-6) | vinyl acetate/vinyl alcohol copolymer (95:5) |
| P-7) | poly(-n-butyl acrylate) |
| P-8) | poly(-n-butyl methacrylate) |
| P-9) | poly(isobutyl methacrylate) |
| P-10) | poly(isopropyl methacrylate) |
| P-11) | poly(decyl methacrylate) |
| P-12) | n-butyl acrylate/acrylamide copolymer (95:5) |
| P-13) | poly(methyl chloroacrylate) |
| P-14) | 1,4-butanediol/adipic acid polyester |
| P-15) | ethylene glycol/sebacic acid polyester |
| P-16) | polycaprolactone |
| P-17) | poly(2-tert-butylphenyl acrylate) |
| P-18) | poly(4-tert-butylphenyl acrylate) |
| P-19) | n-butyl methacrylate/N-vinyl-2-pyrrolidone copolymer (90:10) |
| P-20) | methyl methacrylate/vinyl chloride copolymer (70:30) |
| P-21) | methyl methacrylate/styrene copolymer (90:10) |
| P-22) | methyl methacrylate/ethyl acrylate copolymer (50:50) |
| P-23) | n-butyl methacrylate/methyl methacrylate/styrene copolymer (50:30:20) |
| P-24) | vinyl acetate/acrylamide copolymer (85:15) |
| P-25) | vinyl chloride/vinyl acetate copolymer (65:35) |
| P-26) | methyl methacrylate/acrylnitrile copolymer (65:35) |

-continued

| Specific example | Polymer species |
|---|---|
| P-27) | diacetone acrylamide/methyl methacrylate copolymer (50:50) |
| P-28) | vinyl methyl ketone/isobutyl methacrylate copolymer (55:45) |
| P-29) | ethyl methacrylate/n-butyl acrylate copolymer (70:30) |
| P-30) | diacetone acrylamide/n-butyl acrylate copolymer (60:40) |
| P-31) | methyl methacrylate/cyclohexyl methacrylate copolymer (50:50) |
| P-32) | n-butyl acrylate/styrene methacrylate/diacetone acrylamide copolymer (70:20:10) |
| P-33) | N-tert-butyl methacrylamide/methyl methacrylamide copolymer (60:30:10) |
| P-34) | methyl methacrylate/styrene/vinyl sulfonamide copolymer (70:20:10) |
| P-35) | methyl methacrylate/phenyl vinyl ketone copolymer (70:30) |
| P-36) | n-butyl acrylate/methyl methacrylate/n-butyl methacrylate copolymer (35:35:30) |
| P-37) | n-butyl methacrylate/pentyl methacrylate/N-vinyl-2-pyrrolidone copolymer (38:38:24) |
| P-38) | methyl methacrylate/n-butyl methacrylate/isobutyl methacrylate/acrylic acid copolymer (37:29:25:9) |
| P-39) | n-butyl methacrylate/acrylic acid copolymer (95:5) |
| P-40) | methyl methacrylate/acrylic acid copolymer (95:5) |
| P-41) | benzyl methacrylate/acrylic acid copolymer (90:10) |
| P-42) | n-butyl methacrylate/methyl methacrylate/benzyl methacrylate/acrylic acid copolymer (35:35:25:5) |
| P-43) | n-butyl methacrylate/methyl methacrylate/benzyl methacrylate copolymer (35:35:30) |
| P-44) | poly-3-pentyl acrylate |
| P-45) | cyclohexyl methacrylate/methyl methacrylate/n-propyl methacrylate copolymer (37:29:34) |
| P-46) | polypentyl methacrylate |
| P-47) | methyl methacrylate/n-butyl methacrylate copolymer (65:35) |
| P-48) | vinyl acetate/vinyl propionate copolymer (75:25) |
| P-49) | n-butyl methacrylate/3-acryloxybutane-1-sulfonic acid sodium copolymer (97:3) |
| P-50) | n-butyl methacrylate/methyl methacrylate/-acrylamide copolymer (35:35:30) |
| P-51) | n-butyl methacrylate/methyl methacrylate/vinyl chloride copolymer (37:36:27) |
| P-52) | n-butyl methacrylate/styrene copolymer (90:10) |
| P-53) | methyl methacrylate/N-vinyl-2-pyrrolidone copolymer (90:10) |
| P-54) | n-butyl methacrylate/vinyl chloride copolymer (90:10) |
| P-55) | n-butyl methacrylate/styrene copolymer (70:30) |
| P-56) | poly(N-sec-butyl acrylamide) |
| P-57) | poly(N-tert-butyl acrylamide) |
| P-58) | diacetone acrylamide/methyl methacrylate copolymer (62:38) |
| P-59) | polycyclohexyl methacrylate/methyl methacrylate/-copolymer (60:40) |
| P-60) | N-tert-butyl acrylamide/methyl methacrylate/-copolymer (40:60) |
| P-61) | poly(N-n-butyl acrylamide) |
| P-62) | poly(tert-butyl methacrylate)/N-tert-butyl methacrylate copolymer (50:50) |
| P-63) | tert-butyl methacrylate/methyl methacrylate/-copolymer (70:30) |
| P-64) | poly(N-tert-butyl methacrylamide) |
| P-65) | N-tert-butyl acrylamide/methyl methacrylate/-copolymer (60:40) |
| P-66) | methyl methacrylate/acrylonitrile copolymer (70:30) |
| P-67) | methyl methacrylate/vinyl methyl ketone copolymer (38:62) |
| P-68) | methyl methacrylate/styrene copolymer (75:25) |
| P-69) | methyl methacrylate/hexyl methacrylate copolymer (70:30) |
| P-70) | poly(benzyl acrylate) |

-continued

| Specific example | Polymer species |
|---|---|
| P-71) | poly(4-biphenyl acrylate) |
| P-72) | poly(4-butoxycarbonylphenyl acrylate) |
| P-73) | poly(sec-butyl acrylate) |
| P-74) | poly(tert-butyl acrylate) |
| P-75) | poly[4-chloro-2,2-bis(chloromethyl)propyl acrylate) |
| P-76) | poly(2-chlorophenyl acrylate) |
| P-77) | poly(4-chlorophenyl acrylate) |
| P-78) | poly(pentachlorophenyl acrylate) |
| P-79) | poly(4-cyanobenzyl acrylate) |
| P-80) | poly(cyanoethyl acrylate) |
| P-81) | poly(4-cyanophenyl acrylate) |
| P-82) | poly(4-cyano-3-thiabutyl acrylate) |
| P-83) | poly(cyclohexyl acrylate) |
| P-84) | poly(2-ethoxycarbonylphenyl acrylate) |
| P-85) | poly(3-ethoxycarbonylphenyl acrylate) |
| P-86) | poly(4-ethoxycarbonylphenyl acrylate) |
| P-87) | poly(2-ethoxyethyl acrylate) |
| P-88) | poly(3-ethoxypropyl acrylate) |
| P-89) | poly(1H,1H,5H-octafluoropentyl acrylate) |
| P-90) | poly(heptyl acrylate) |
| P-91) | poly(hexadecyl acrylate) |
| P-92) | poly(hexyl acrylate) |
| P-93) | poly(isobutyl acrylate) |
| P-94) | poly(isopropyl acrylate) |
| P-95) | poly(3-methoxybutyl acrylate) |
| P-96) | poly(2-methoxycarbonylphenyl acrylate) |
| P-97) | poly(3-methoxycarbonylphenyl acrylate) |
| P-98) | poly(4-methoxycarbonylphenyl acrylate) |
| P-99) | poly(2-methoxyethyl acrylate) |
| P-100) | poly(4-methoxyphenyl acrylate) |
| P-101) | poly(3-methoxypropyl acrylate) |
| P-102) | poly(3,5-dimethyladamantyl acrylate) |
| P-103) | poly(3-dimethylaminophenyl acrylate) |
| P-104) | polyvinyl-tert-butylate |
| P-105) | poly(2-methylbutyl acrylate) |
| P-106) | poly(3-methylbutyl acrylate) |
| P-107) | poly(1,3-dimethylbutyl acrylate) |
| P-108) | poly(2-methylpentyl acrylate) |
| P-109) | poly(2-naphthyl acrylate) |
| P-110) | poly(phenyl acrylate) |
| P-111) | poly(propyl acrylate) |
| P-112) | poly(m-tolyl acrylate) |
| P-113) | poly(o-tolyl acrylate) |
| P-114) | poly(p-tolyl acrylate) |
| P-115) | poly(N,N-dibutyl acrylamide) |
| P-116) | poly(isohexyl acrylamide) |
| P-117) | poly(isooctyl acrylamide) |
| P-118) | poly(N-methyl-N-phenyl acrylamide) |
| P-119) | poly(adamantyl methacrylate) |
| P-120) | poly(benzyl methacrylate) |
| P-121) | poly(2-bromoethyl methacrylate) |
| P-122) | poly(2-N-tert-butylaminoethyl methacrylate) |
| P-123) | poly(sec-butyl methacrylate) |
| P-124) | poly(tert-butyl methacrylate) |
| P-125) | poly(2-chloroethyl methacrylate) |
| P-126) | poly(2-cyanoethyl methacrylate) |
| P-127) | poly(2-cyanomethylphenyl methacrylate) |
| P-128) | poly(4-cyanophenyl methacrylate) |
| P-129) | poly(cyclohexyl methacrylate) |
| P-130) | poly(dodecyl methacrylate) |
| P-131) | poly(diethylaminoethyl methacrylate) |
| P-132) | poly(2-ethylsulfinylethyl methacrylate) |
| P-133) | poly(hexadecyl methacrylate) |
| P-134) | poly(hexyl methacrylate) |
| P-135) | poly(2-hydroxypropyl methacrylate) |
| P-136) | poly(4-methoxycarbonylphenyl methacrylate) |
| P-137) | poly(3,5-dimethyladmantyl methacrylate) |
| P-138) | poly(dimethylaminoethyl methacrylate) |
| P-139) | poly(3,3-dimethylbutyl methacrylate) |
| P-140) | poly(3,3-dimethyl-2-butyl methacrylate) |
| P-141) | poly(3,5,6-trimethylhexyl methacrylate) |
| P-142) | poly(octadecyl methacrylate) |
| P-143) | poly(tetradecyl methacrylate) |
| P-144) | poly(4-butoxycarbonylphenyl methacrylamide) |
| P-145) | poly(4-carboxyphenyl methacrylamide) |
| P-146) | poly(4-ethoxycarbonylphenyl methacrylamide) |
| P-147) | poly(4-methoxycarbonylphenyl methacrylamide) |
| P-148) | poly(butylbutoxycarbonyl methacrylate) |
| P-149) | poly(butyl chloroacrylate) |

-continued

| Specific example | Polymer species |
|---|---|
| P-150) | poly(butyl cyanoacrylate) |
| P-151) | poly(cyclohexyl chloroacrylate) |
| P-152) | poly(ethyl chloroacrylate) |
| P-153) | poly(ethylethoxycarbonyl methacrylate) |
| P-154) | poly(ethyl ethacrylate) |
| P-155) | poly(ethylfluoro methacrylate) |
| P-156) | poly(hexylhexyloxycarbonyl methacrylate) |
| P-157) | poly(isobutyl chloroacrylate) |
| P-158) | poly(isopropyl chloroacrylate) |

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprise a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over.

Further in the photographic material suitable for an rapid processing a emulsion of high silver chloride content, so-called a high-silver-chloride emulsion may be used preferably. The content of silver chloride of the high-silver-chloride emulsion is preferably 90 mol % or over, more preferably 95 mol % or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Physique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in "Heterocyclic compounds—Cyanine dyes and related compounds" (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), and (Y):

Formula (C-I)

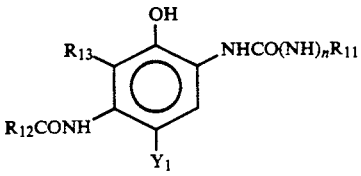

Formula (C-II)

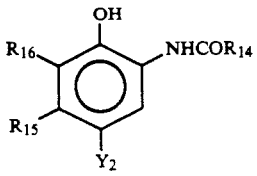

Formula (M-I)

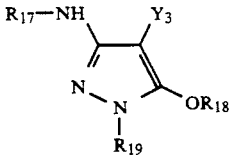

Formula (Y)

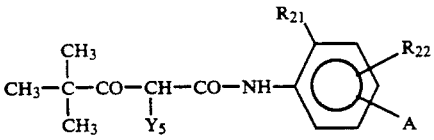

In formulae (C-I) and (C-II), $R_{11}$, $R_{12}$, and $R_{14}$ each represent a substituted or unsubstituted aliphatic, aromatic, or heterocyclic group, $R_{13}$, $R_{15}$, and $R_{16}$ each represent a hydrogen atom, a halogen atom, an aliphatic group, an aromatic group, or an acylamino group, $R_{13}$ and $R_{12}$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_{15}$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_{11}$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_{13}$ and $R_{12}$ together do not form a ring, $R_{12}$ is preferably a substituted or unsubstituted alkyl group, or aryl group, and particularly preferably an alkyl group substituted by a substituted aryloxy, and preferably $R_{13}$ represents a hydrogen atom.

In formula (C-II), preferable $R_{14}$ is a substituted or unsubstituted alkyl group or aryl group, and particularly preferably an alkyl group substituted by a substituted aryloxy group.

In formula (C-II), preferable $R_{15}$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_{15}$ is an alkyl group having 2 to 15 carbon atoms, and particularly preferably an alkyl group having 2 to 4 carbon atoms.

In formula (C-II), preferable $R_{16}$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_{17}$ and $R_{19}$ each represent an aryl group, $R_{18}$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_{17}$ and $R_{19}$ are the same substituents as those allowable for the substituent $R_{11}$, and if there are two substituents, they may be the same or different. $R_{18}$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (Y), $R_{21}$ represents a halogen atom, an alkoxy group, a trifluoromethyl group, or an aryl group, and $R_{22}$ represents a hydrogen atom, a halogen atom, or an alkoxy group. A represents $-NHCOR_{23}$, $-NHSO_2-R_{23}$, $-SO_2NHR_{23}$, $-COOR_{23}$, or $$-SO_2\underset{\underset{R_{24}}{|}}{N}-R_{23},$$

wherein $R_{23}$ and $R_{24}$ each represent an alkyl group, an aryl group, or an acyl group. $Y_5$ represents a coupling split-off group. Substituents of $R_{22}$, $R_{23}$, and $R_{24}$ are the same as those allowable for $R_{11}$ and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), and (Y) are listed below.
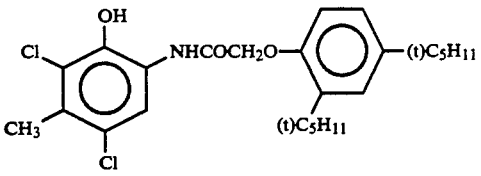
(C-1)
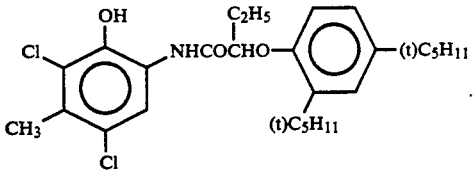
(C-2)
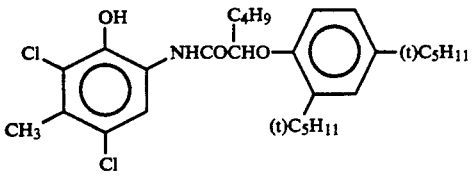
(C-3)
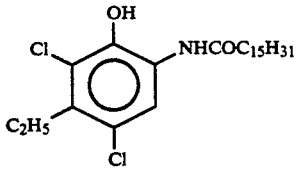
(C-4)
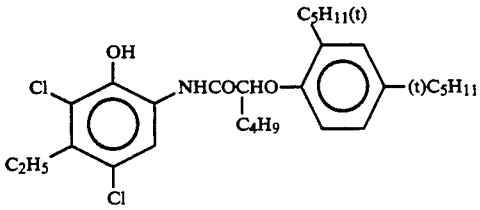
(C-5)
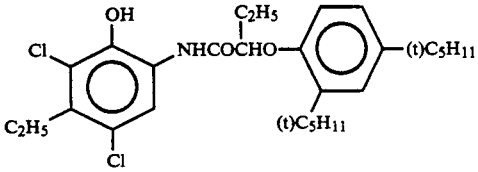
(C-6)
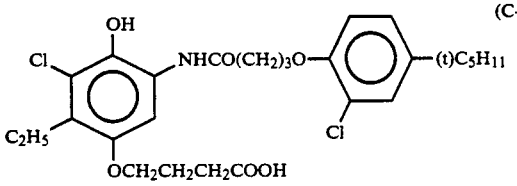
(C-7)
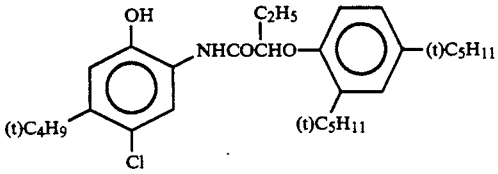
(C-8)
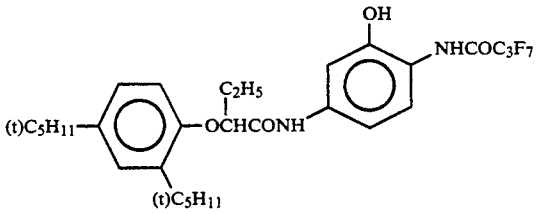
(C-9)
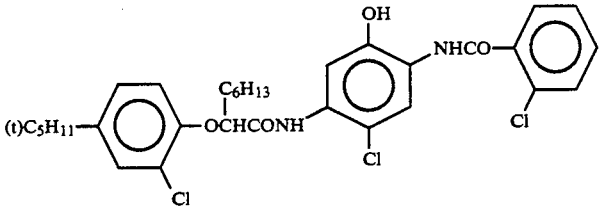
(C-10)
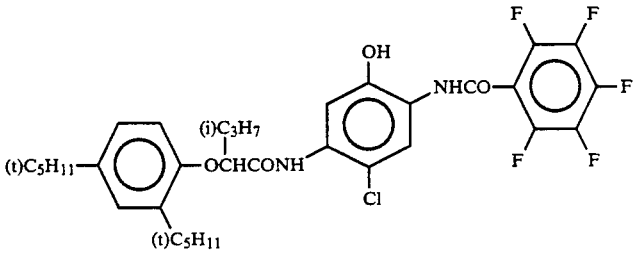
(C-11)

-continued
(C-12)
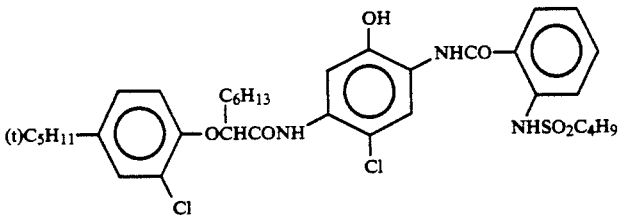
(C-13)
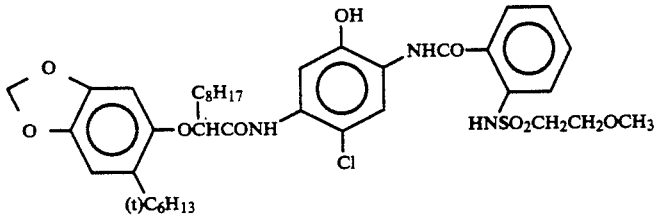
(C-14)
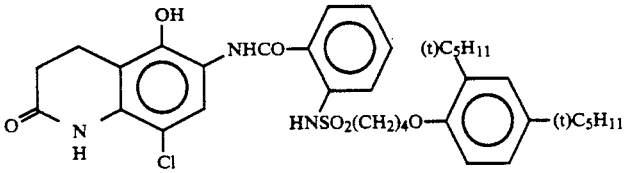
(C-15)
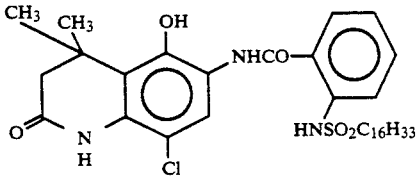
(C-16)
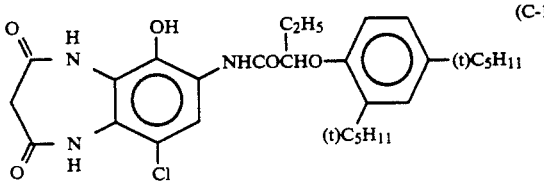
(C-17)
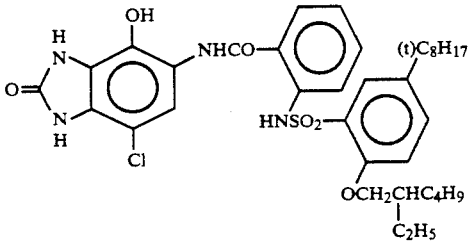
(C-18)
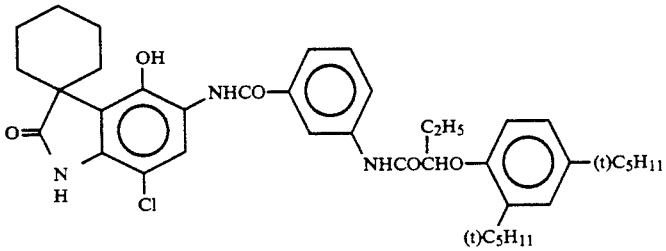
(C-19)
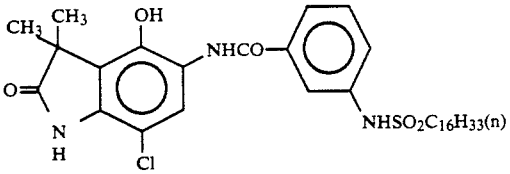

-continued
(C-20)
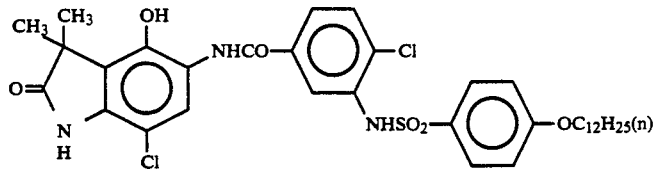
(C-21)
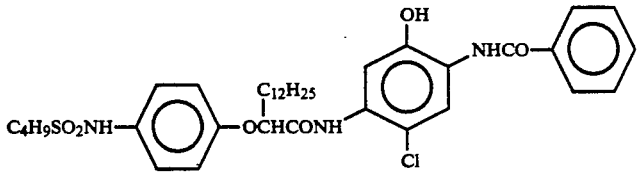
(C-22)
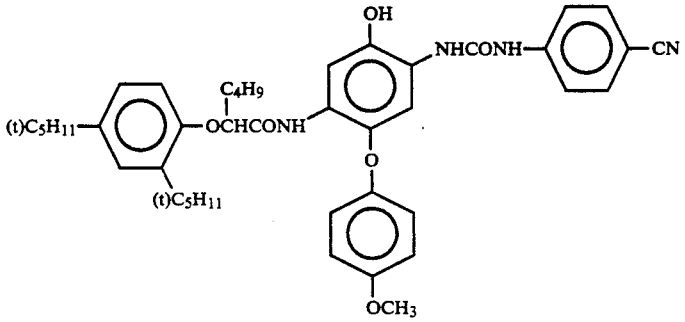
(M-1)
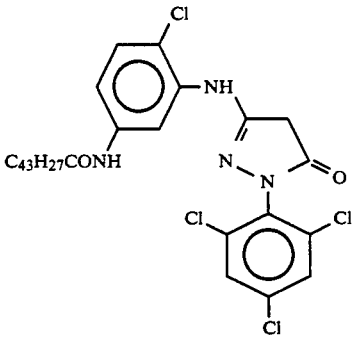
(M-2)
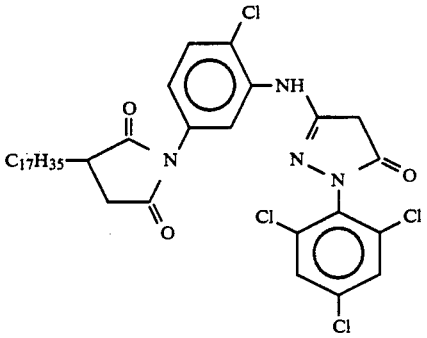
(M-3)
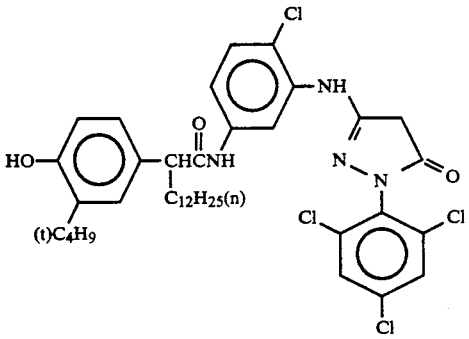
(M-4)
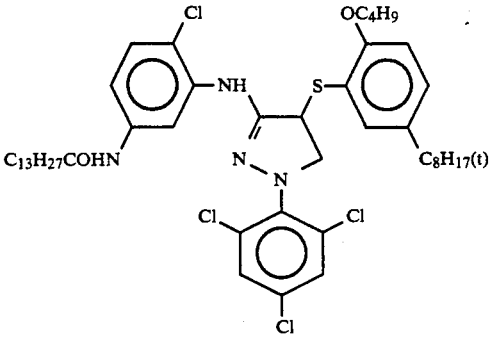

-continued
(M-5)
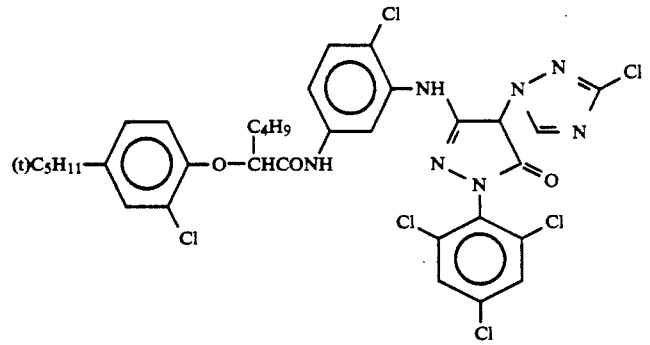
(M-6)
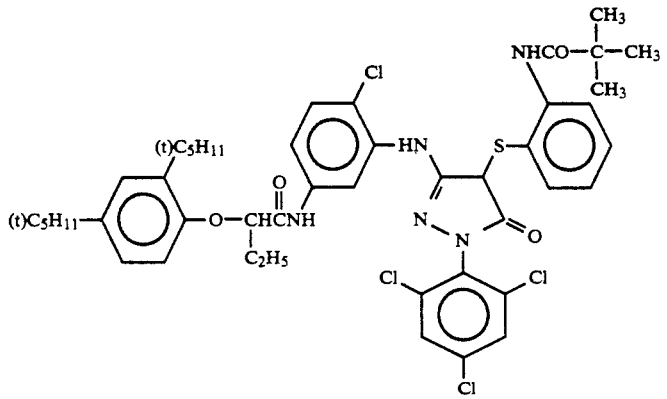
(M-7)
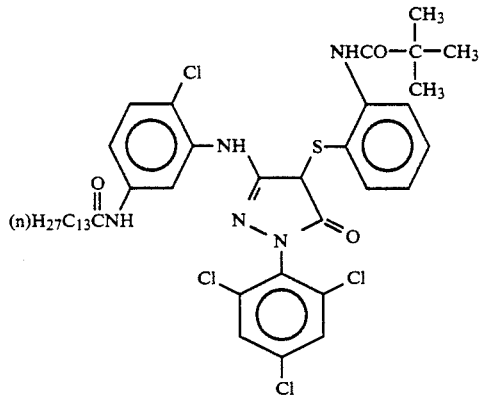
(M-8)
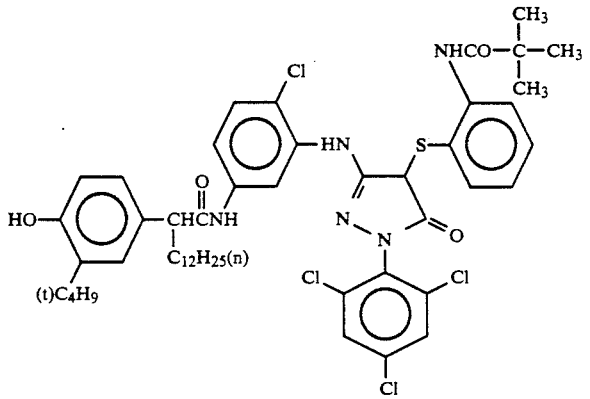

(Y-1)
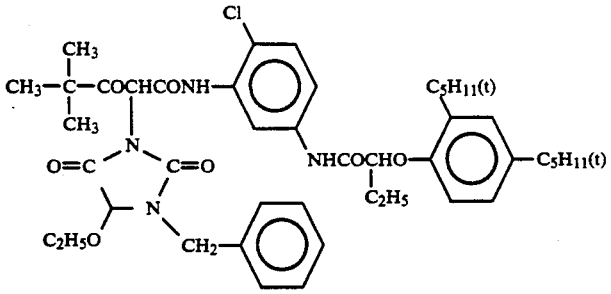
(Y-2)
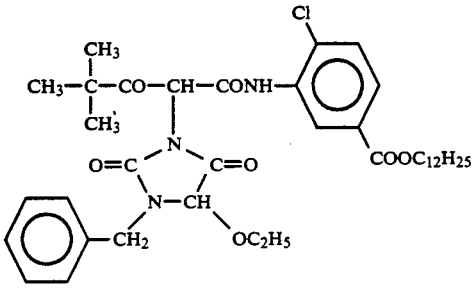
(Y-3)
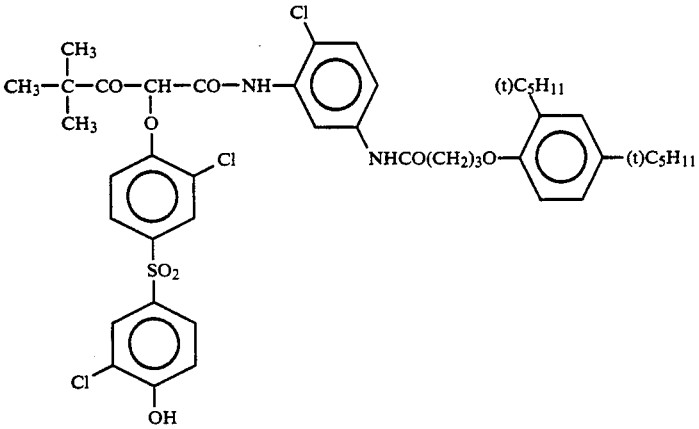
(Y-4)
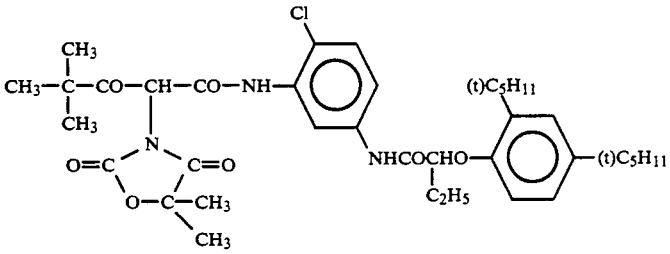
(Y-5)
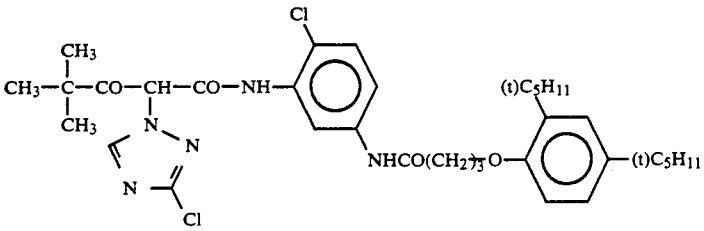

-continued (Y-6)

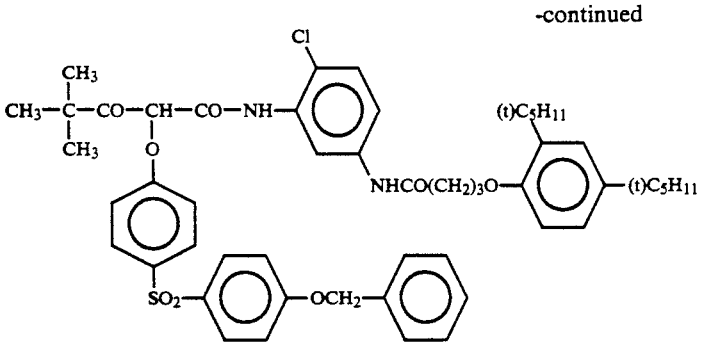

(Y-7)

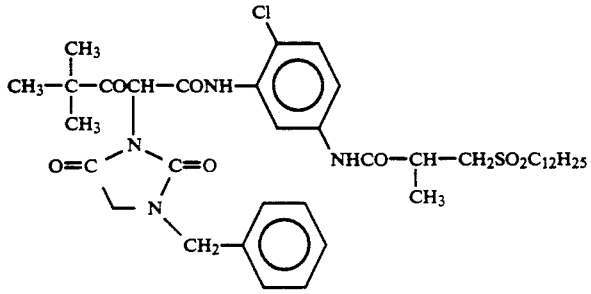

(Y-8)

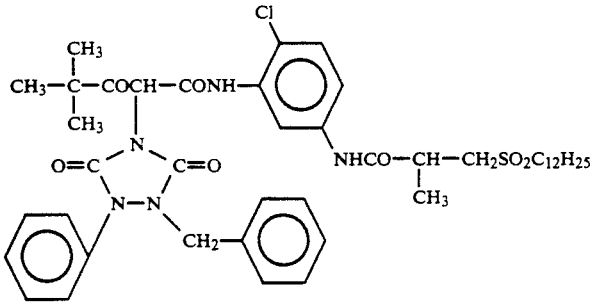

(Y-9)

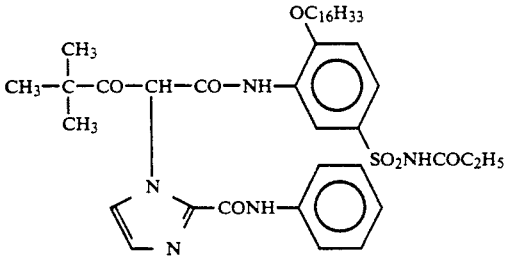

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or an water-insoluble polymer compound having a dielectric constant of 2 to 20 (25° C.) and a refractive index of 1.5 to 1.7 (25° C.).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{31}-(A)_n-X_{31} \qquad \text{Formula (FI)}$$

$$R_{32}-\underset{\underset{B}{|}}{C}=Y_{32} \qquad \text{Formula (FII)}$$

wherein $R_{31}$ and $R_{32}$ each represent an aliphatic group, an aromatic group, or a heterocyclic group, n is 1 or 0, A represents a group that will react with an aromatic amine developing agent to form a chemical bond therewith, $X_{31}$ represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{31}$ and $X_{31}$, or $Y_{32}$ and $R_{32}$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{33}—Z_{33} \qquad \text{Formula (GI)}$$

wherein $R_{33}$ represents an aliphatic group, an aromatic group, or a heterocyclic group, $Z_{33}$ represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-\overline{R})^2}{n-1}} \Big/ \frac{\sum_{i=1}^{n} R_i}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 l or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air. The contact area of the photographic processing solution with the air in the processing tank is represented by the opened surface ratio which is definited as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $\text{cm}^{-1}$ or less, more preferably 0.001 to 0.05 $\text{cm}^{-1}$.

Methods for reducing the opened surface ratio that can be mentioned include a utilization of movable lids as described in JP-A NO. 241342/1987 and a slit-developing process as described in JP-A No. 216050/1988, besides a method of providing a shutting materials such as floating lids.

It is preferable to adopt the means for reducing the opened surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acie, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 95630/1978, and *Research Disclosure* No. 17129 (July, 1978); thiazolidine derivatives, described in JP-A No. 140129/1975; thiourea derivatives, described in U.A. Pat. No. 3,706,561; iodide salts, described in JP-A No. 16235/1983; polyoxyethylene compounds in West German Patent No. 2,748,460; polyamine compounds, described in JP-B No. 8836/1970; and bromide ions. Of these, compounds having a mercapto group or a disulfide group are preferable in view of higher acceleration effect, and in particular, compounds described in U.A. Pat. No. 3,893,858, West German Patent No. 1,290,812, and JP-A No. 95630/1978 are preferable. Compound described in U.S. Pat. No. 4,552,834 are preferable. These bleach-accelerating agents may be added into a photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flowed solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution. Also, to save the silver of the photographic material, a process using hydrogen peroxide intensification or cobalt intensification described in West German Patent No. 2,226,770 and U.S. Pat. No. 3,674,499 may be carried out.

Next, the present invention will be described in detail in accordance with examples, but the invention is not limited to these Examples.

EXAMPLE 1

A multilayer photographic material was prepared by multi-coatings composed of the following layer composition on a two-side polyethylene laminated paper support. Coating solutions were prepared as follows:

PREPARATION OF THE FIRST LAYER COATING SOLUTION

To a mixture of 19.1 g of yellow coupler (ExY), 4.4 g of image-dye stabilizer (Cpd-1) and 1.8 g of image-dye stabilizer (Cpd-7), 27.2 ml of ethyl acetate and each 4.1 g of solvents (Solv-3) and (Solv-6) were added and dissolved. The resulting solution was dispersed and emulsified in 185 ml of 10% aqueous gelatin solution containing 8 ml of sodium dodecylbenzenesulfonate. Separately another emulsion was prepared by adding a blue-sensitive sensitizing dye, shown below, to a blend of silver chlorobromide emulsions (mixture in silver molar ratio of 1:3 of two respectively having 0.88 μm and 0.7 μm of average grain size, and 0.08 and 0.10 of deviation coefficient of grain size distribution) in such amounts that the sensitizing dye corresponds $5.0\times10^{-4}$ mol per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

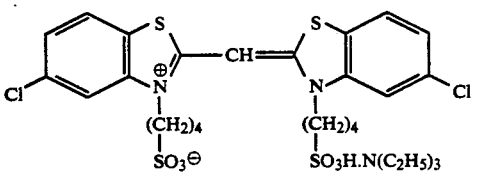

($5.0 \times 10^{-4}$ mol per mol of silver halide)

Green-sensitive emulsion layer:

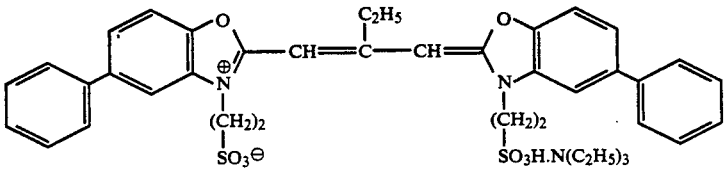

($4.0 \times 10^{-4}$ mol per mol of silver halide)

and

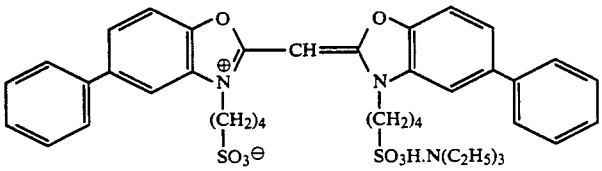

($7.0 \times 10^{-5}$ mol per mol of silver halide)

Red-sensitive emulsion layer:

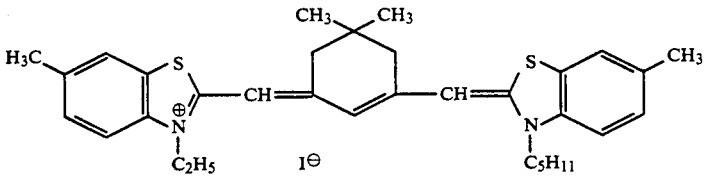

($0.9 \times 10^{-4}$ mol per mol of silver halide)

To the red-sensitive emulsion layer, the following compound was added in an amount of $2.6 \times 10^{-3}$ mol per mol of silver halide:

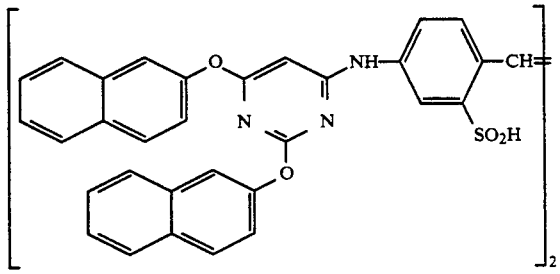

Further, to the blue-sensitive emulsion layer, the green-sensitive layer, and the red-sensitive layer, 1-(5-methylureidopheyl)-5-mercaptotetrazole was added in amounts of $4.0 \times 10^{-6}$ mol, $3.0 \times 10^{-5}$ mol, and $1.0 \times 10^{-5}$ mol per mol of silver halide, respectively, and 2-methyl-5-t-octylhydroquinone was added in amounts of $8 \times 10^{-3}$ mol, $2 \times 10^{-2}$ mol, and $2 \times 10^{-2}$ mol per mol of silver halide, respectively.

Further, to the blue-sensitive emulsion layer and the green-sensitive layer 4-hydroxy-6-methyl-1,3,3a,7-tetrazaubdebe was added in amounts of $1.2 \times 10^{-2}$ mol and $1.1 \times 10^{-2}$ mol per mol of silver halide, respectively.

The following dyes were added to the emulsion were to prevent irradiation.

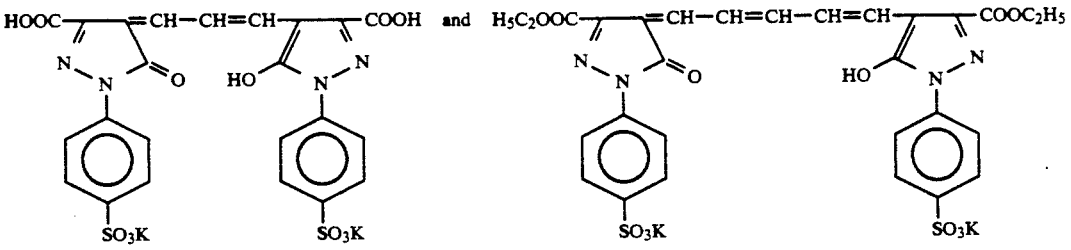

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer): | |
| The above-described silver chlorobromide emulsion | 0.26 |
| Gelatin | 1.86 |
| Yellow coupler (ExY) | 0.83 |
| Image-dye stabilizer (Cpd-1) | 0.19 |
| Image-dye stabilizer (Cpd-7) | 0.08 |
| Solvent (Solv-3) | 0.18 |
| Solvent (Solv-6) | 0.18 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:1 (Ag mol ratio) blend of grains having 0.47 μm and 0.36 μm of average grain size, and 0.12 and 0.09 of deviation coefficient of grain size distribution, respectively, each having 90 mol % of AgBr) | 0.16 |
| Gelatin | 1.79 |
| Magenta coupler | see Table 1 |
| Image-dye stabilizer (Cpd-3) | 0.20 |
| Image-dye stabilizer (Cpd-4) | 0.01 |
| Image-dye stabilizer (Cpd-8) | 0.03 |
| Image-dye stabilizer (Cpd-9) | 0.02 |
| Solvent (Solv-4) | see Table 1 |
| Polymer | see Table 1 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each having 90 mol % of AgBr) | 0.23 |
| Gelatin | 1.34 |
| Cyan coupler (ExC) | 0.30 |
| Image-dye stabilizer (Cpd-6) | 0.17 |
| Image-dye stabilizer (Cpd-7) | 0.40 |
| Solvent (Solv-6) | 0.20 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |

-continued

| | |
|---|---|
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(Cpd-1) Image-dye stabilizer

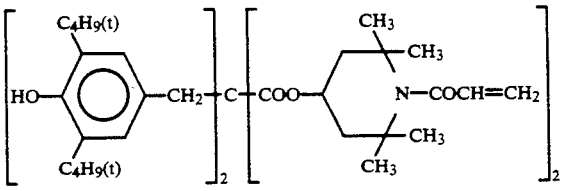

(Cpd-3) Image-dye stabilizer

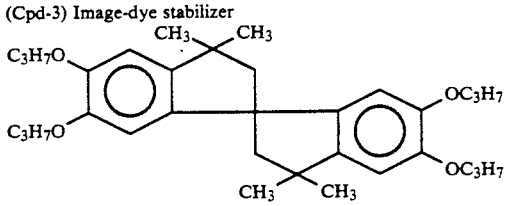

(Cpd-4) Image-dye stabilizer

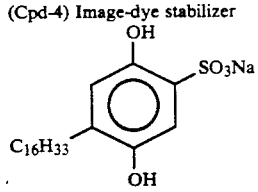

(Cpd-5) Color-mix inhibitor

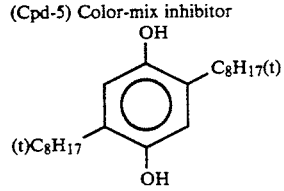

(Cpd-6) Image-dye stabilizer
Mixture (2:4:4 in weight ratio) of

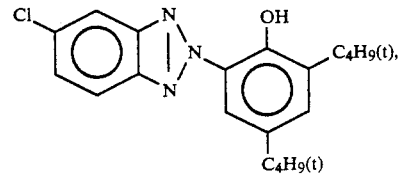

-continued

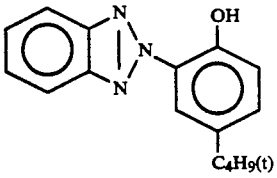

, and

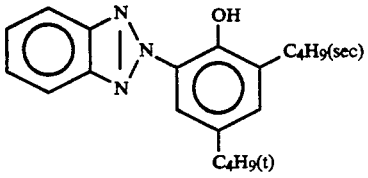

(Cpd-7) Image-dye stabilizer $\text{-}(CH_2\text{-}CH)_n\text{-}$
|
$CONHC_4H_9(t)$ Average molecular weight: 80,000

(Cpd-8) Image-dye stabilizer

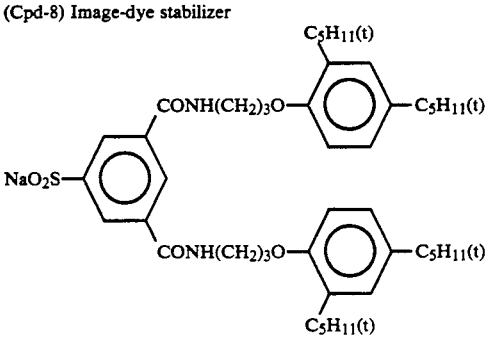

(Cpd-9) Image-dye stabilizer

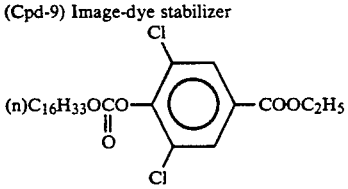

(UV-1) Ultraviolet ray absorber

Mixture (4:2:4 in weight ratio) of

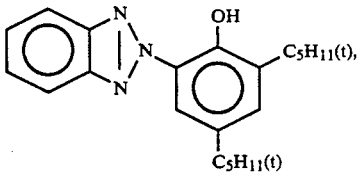

-continued

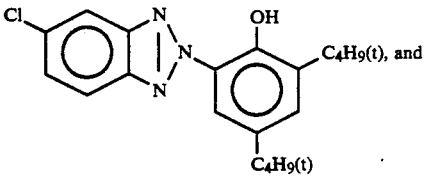

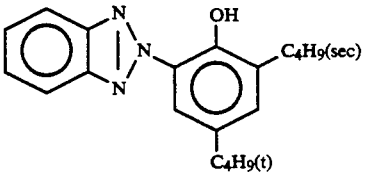

(Solv-1) Solvent

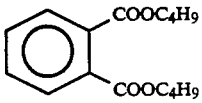

(Solv-2) Solvent

Mixture (2:1 in volume ratio) of

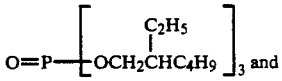

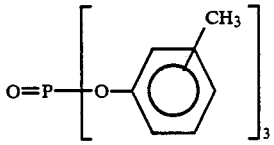

(Solv-3) Solvent $O{=}P\text{-}[O\text{-}C_9H_{19}(iso)]_3$ (Solv-4) Solvent

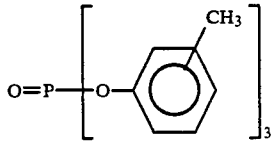

(Solv-5) Solvent $COOC_8H_{17}$
|
$(CH_2)_8$
|
$COOC_8H_{17}$ (Solv-6) Solvent $C_8H_{17}CHCH(CH_2)_7COOC_8H_{17}$
$\backslash\ /$
$O$ (ExY) Yellow coupler Mixture (1:1 in molar ratio) of R = 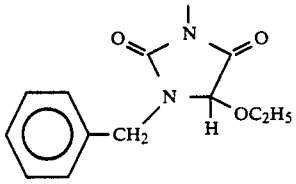 and R = 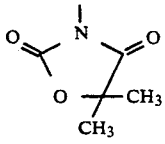

of the following formula

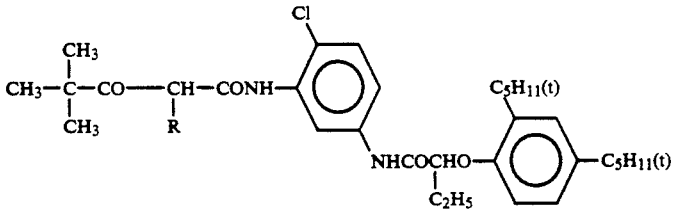

(ExC) Cyan coupler
Mixture (1:1 in molar ratio) of

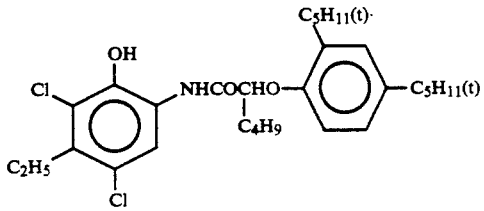

and

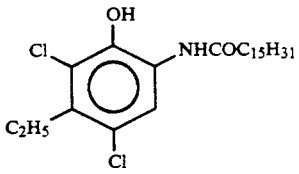

Each of samples above described was subjected to a gradation exposure to light through three color separated filters for sensitometry using a sensitometer (FWH model by Fuji Photo Film Co., Ltd., the color temperature of light source was 3200K). At that time, the exposure was carried out in such a manner that the exposure was 250 CMS with the exposure time being 0.1 second.

After exposure to light, each sample was subjected to the processing process in accordance with processing steps and processing solutions shown below using an automatic processor.

| Processing step | Temperature | Time |
|---|---|---|
| Color developing | 37° C. | 3 min. 30 sec. |
| Bleach-fixing | 33° C. | 1 min. 30 sec. |
| Water-washing | 24–34° C. | 3 min. |
| Drying | 70–80° C. | 1 min. |

The compositions of each processing solution were as follows:

-continued

| | |
|---|---|
| Color developer | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| Hydroxylamine sulfate | 3.0 g |
| N-ethyl-N-(β-methanesulfonamidoethyl)-3-methyl-4-aminoaniline sulfate | 4.5 g |
| Hydroxylamine sulfate | 3.0 g |
| Fluorescent brightening agent (WHITEX-4, made by Sumitomo Chem. Ind. Co., Ltd.) | 1.0 g |
| Water to make | 1000 ml |
| pH (25° C.) | 10.25 |
| Bleach-fixing solution | |
| Distilled water | 400 ml |
| Ammonium thiosulfate (70%) | 150 ml |
| Sodium sulfite | 18 g |
| Iron (III) ammonium ethylenediamine-tetraacetate | 55 g |
| Disodium ethylenediaminetetraacetate | 5 g |
| Water to make | 1000 ml |
| pH (25° C.) | 6.70 |

Light-Fastness Test

Densities of green on each sample before and after fading by irradiation of sun light for 35 day by using an under glass outdoor radiation box were measured.

Each degree of fading (fading rate) on high density part and low density part was determined as follows:

High density part: Evaluation of the part having an optical reflection density of 2.0 before fading $$\text{Fading rate (\%)} = \frac{2.0 - D}{2.0} \times 100$$

Low density part: Evaluation of the part having an optical reflection density of 0.50 before fading $$\text{Fading rate (\%)} = \frac{0.50\text{–}0.12 - D}{0.50\text{–}0.12} \times 100$$

TABLE 1

| Sample No. | Magenta Coupler | High-boiling Solvent/ Coupler | Compound of Forumla (II) | Polymer Species | Fading Ratio (%) High Density | Fading Ratio (%) Low Density | Remarks |
|---|---|---|---|---|---|---|---|
| 101 | (A) for Comparison | 2.0 | — | — | 35 | 85 | Comparative Example |
| 102 | (A) for Comparison | 3.7 | II-7 | — | 33 | 81 | " |
| 103 | I-7 | 2.0 | — | — | 24 | 65 | " |
| 104 | I-7 | 3.7 | — | — | 16 | 66 | " |
| 105 | I-7 | 3.7 | II-7 | — | 12 | 19 | This Invention |
| 106 | I-7 | 3.7 | II-7 | P-134 | 12 | 16 | " |
| 107 | I-5 | 2.0 | — | — | 31 | 67 | Comparative Example |

TABLE 1-continued

| Sample No. | Magenta Coupler | High-boiling Solvent/ Coupler | Compound of Forumla (II) | Polymer Species | Fading Ratio (%) High Density | Fading Ratio (%) Low Density | Remarks |
|---|---|---|---|---|---|---|---|
| 108 | I-5 | 2.0 | II-15 | — | 28 | 24 | " |
| 109 | I-5 | 3.8 | II-15 | — | 16 | 20 | This Invention |
| 110 | I-5 | 3.8 | II-15 | P-57 | 17 | 18 | " |
| 111 | I-5 | 2.0 | W-1 for Comparison | — | 27 | 57 | Comparative Example |
| 112 | I-5 | 3.8 | W-1 for Comparison | — | 20 | 61 | " |
| 113 | I-12 | 4.0 | II-17 | — | 19 | 20 | This Invention |

Note:
*1 The amount of compound represented by formula (II) and comparative compound to be added was 0.4 mol per mol of coupler, respectively.
*2 The coating amount of magenta coupler was $3.5 \times 10^{-4}$ mol/m$^2$. The amount of polymer added was 0.5 times weight of magenta coupler.

As is apparent from the results of Table 1, it can be understood that sample of the present invention, as compared with comparative samples, is superior in light fastness with good balance from high density part to low density part because of improved light fastnesses of high density part and low density part.

Comparative magenta coupler (A)

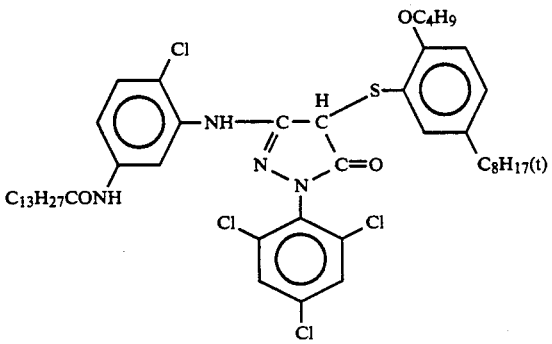

Comparative image-dye stabilizer

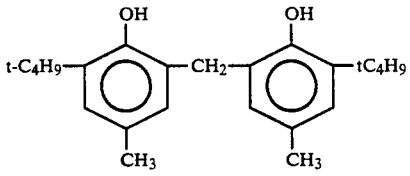

W-1

EXAMPLE 2

A multilayer photographic material was prepared by multi-coatings composed of the following layer composition on a two-side polyethylene laminated paper support. Coating solutions were prepared as follows:

PREPARATION OF THE FIRST LAYER COATING SOLUTION

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0 \times 10^{-4}$ mol to the large size emulsion and $2.5 \times 10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

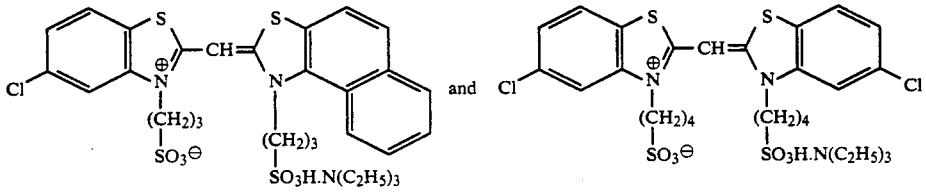

(each $2.0 \times 10^{-4}$ mol to the large size emulsion and $2.5 \times 10^{-4}$ mol to the small size emulsion, per mol of silver halide.)

Green-sensitive emulsion layer:

-continued

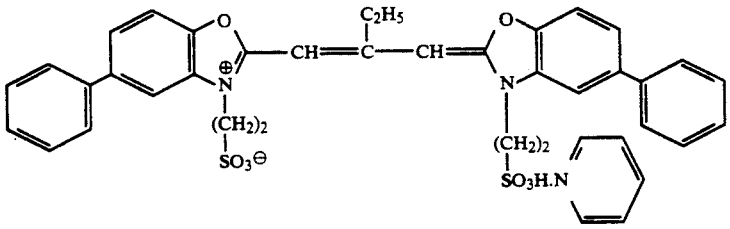

(4.0 × $10^{-4}$ mol to the large size emulsion and
5.6 × $10^{-4}$ mol to the small size emulsion, per mol of silver halide)

and

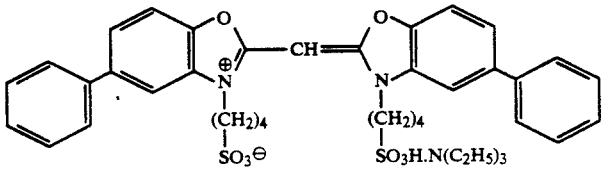

(7.0 × $10^{-5}$ mol to the large size emulsion and
1.0 × $10^{-5}$ mol to the small size emulsion, per mol of silver halide)

Red-sensitive emulsion layer:

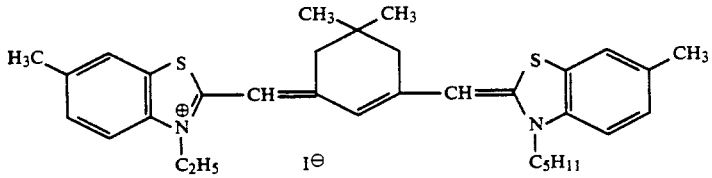

(0.9 × $10^{-4}$ mol to the large size emulsion and
1.1 × $10^{-4}$ mol to the small size emulsion, per mol of silver halide)

To the red-sensitive emulsion layer, the compound was added in an amount of $2.6\times10^{-3}$ mol per mol of silver halide:

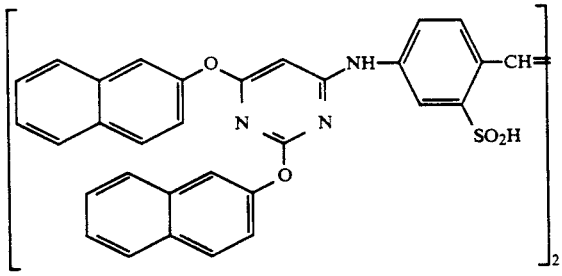

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, to the blue-sensitive emulsion layer and the green-sensitive layer 4-hydroxy-6-methyl-1,3,3a,7-tetrazaubdebe was added in amounts of $1\times10^{-4}$ mol and $2\times10^{-4}$ mol per mol of silver halide, respectively.

The dyes shown below were added to the emulsion layers for prevention of irradiation.

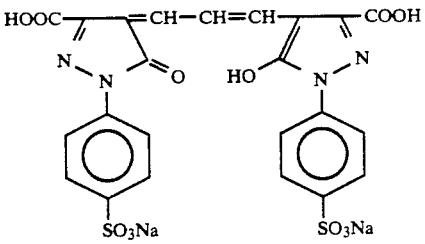

and

-continued

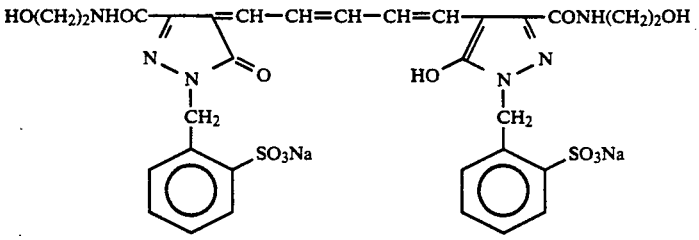

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color-mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler | see Table 2 |
| Image-dye stabilizer (Cpd-2) | 0.03 |
| Image-dye stabilizer (Cpd-3) | 0.15 |
| Image-dye stabilizer (Cpd-4) | 0.02 |
| Solvent | see Table 2 |
| Polymer | see Table 2 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm nd 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |

-continued

| | |
|---|---|
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compound used are as follows:

(ExY) Yellow coupler

The same as in Example 1.

(ExC) Cyan coupler

Mixture (2:4:4 in weight ratio) of $R=C_2H_5$ and $C_4H_9$ of

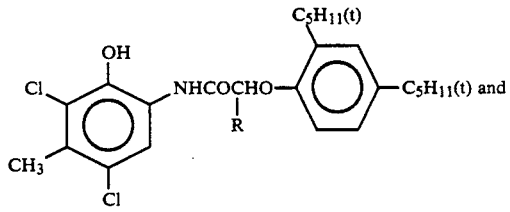

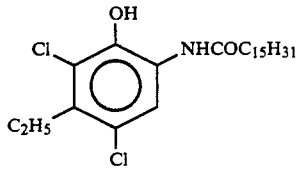

(Cpd-1) Image-dye stabilizer

The same as in Example 1.

(Cpd-2) Image-dye stabilizer

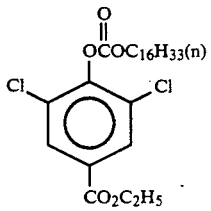

(Cpd-3) Image-dye stabilizer

The same as in Example 1

(Cpd-4) Image-dye stabilizer

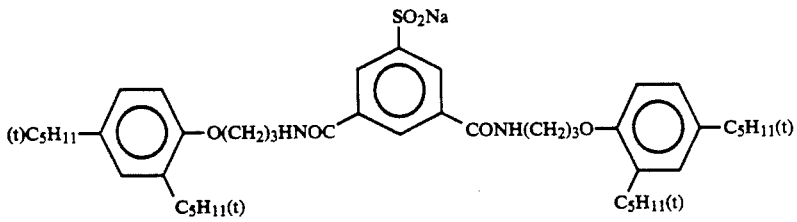

(Cpd-5) Color-mix inhibitor

The same as in Example 1

(Cpd-6) Image-dye stabilizer

The same as in Example 1

(Cpd-7) Image-dye stabilizer

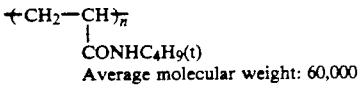

Average molecular weight: 60,000

(Cpd-8) Image-dye stabilizer

Mixture (1:1 in weight ratio) of

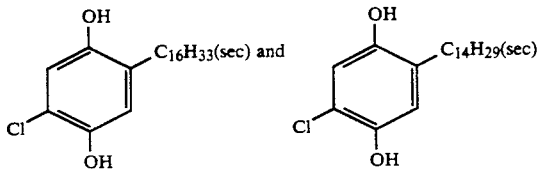

(UV-1) Ultraviolet ray absorber the same as in Example 1

(Solv-1) Solvent

The same as in Example 1

(Solv-2) Solvent

The same as in Example 1

(Solv-3) Solvent

The same as in Example 1

(Solv-4) Solvent the same as in Example 1

(Solv-5) Solvent

The same as in Example 1

(Solv-6) Solvent

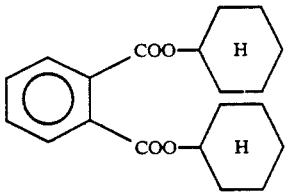

Each of samples was subjected to an exposure to light in accordance with the manner as described in Example 1. After exposure to light, each sample was subjected to a continuous processing (running test) according to the processing steps described below by using a paper-processor until the replenishing amount reached to 2-times the tank volume.

| Processing step | Temperature | Time | Replenisher* | Tank Volume |
|---|---|---|---|---|
| Color-developing | 37° C. | 45 sec. | 161 ml | 17 l |
| Bleaching-fixing | 30–35° C. | 45 sec. | 215 ml | 17 l |
| Rinsing ① | 30–35° C. | 20 sec. | — | 10 l |
| Rinsing ② | 30–35° C. | 20 sec. | — | 10 l |
| Rinsing ③ | 30–35° C. | 20 sec. | 350 ml | 10 l |
| Drying | 70–80° C. | 60 sec. | | |

Note:
*replenisher amount ml/m² of photographic material
The rinsing steps were carried out in a 3-tanks countercurrent mode from the tank of rinsing ③ towards the tank of rinsing ①.

The composition of each processing solution was as follows:

| Color developer | Tank solution | Replenisher |
|---|---|---|
| Water | 800 ml | 800 ml |
| Ethylenediamine-N,N,N,N-tetramethylene phosphonic acid | 1.5 g | 2.5 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)hydrazine | 5.5 g | 7.0 g |
| Fluorescent brightening agent (WHITEX-4, made by Sumitomo Chem. Ind. Co., Ltd.) | 1.0 g | 2.0 g |
| Water to make | 1000 ml | 1000 ml |
| pH (25° C.) | 10.025 | 10.45 |

Bleach-fixing solution
(Both tank solution and replenisher)

| | |
|---|---|
| Water | 400 ml |
| Ammonium thiosulfate (70%) | 100 ml |
| Sodium sulfite | 17 g |
| Iron (III) ammonium ethylenediamine-tetraacatate | 55 g |
| Disodium ethylenediaminetetraacetate | 5 g |
| Ammonium bromide | 40 g |
| Water to make | 1000 ml |
| pH | 6.70 |

RINSING SOLUTION

Both tank solution and replenisher

Ion-exchanged water (concentration of each calcium and magnesium was 3 ppm or below)

TABLE 2

| Sample No. | Magenta Coupler | High-boiling Solv. Species | High-boiling Solv. amount/ coupler | Compound of Formula (II) | Polymer Species | Fading Ratio (%) High Density | Fading Ratio (%) Low Density | Remarks |
|---|---|---|---|---|---|---|---|---|
| 201 | I-5 | S-3 | 3.7 | W-1 | — | 19 | 76 | Comparative Example |
| 202 | I-5 | S-3 | 3.7 | W-2 | — | 19 | 81 | " |
| 203 | I-5 | S-3 | 3.7 | W-3 | — | 20 | 78 | " |
| 204 | I-5 | S-3 | 3.7 | W-4 | — | 20 | 75 | " |
| 205 | I-5 | S-3 | 3.7 | II-7 | — | 16 | 19 | This Invention |
| 206 | I-5 | S-8 | 2.0 | II-7 | — | 27 | 18 | Comparative Example |
| 207 | I-5 | S-8 | 4.0 | II-7 | — | 18 | 18 | This Invention |
| 208 | I-5 | S-8 | 4.0 | II-18 | P-124 | 18 | 15 | " |
| 209 | I-7 | S-73 | 4.5 | II-18 | — | 18 | 16 | " |
| 210 | I-5 | S-71 | 2.0 | II-7 | — | 32 | 19 | Comparative Example |
| 211 | I-5 | S-71 | 4.0 | II-7 | — | 16 | 20 | This Invention |

Note:
*1 The amount of compound represented by formula (II) and comparative compound to be added was 0.4 mol per mol of coupler, respectively.
*2 The coating amount of magenta coupler was $3.7 \times 10^{-4}$ mol/m$^2$. The amount of polymer added was two times wieght of magenta coupler.
*3 Methods for light-fastness test and fading rate determination were carried out in the same manner as in Example 1.

As is apparent from the results of Table 2, it can be understood that samples of the present invention are remarkably improved in light fastnesses of high density part and low density part. It is also understood that the effect of comparative compound that has a similar structure to that of compound represented by formula (II) of the present invention is inferior. Further, it can be understood that the combination of compound of the present invention and high boiling solvent for coupler exhibits a remarkable effect on improving the light fastness. Image-dye stabilizers for comparison:

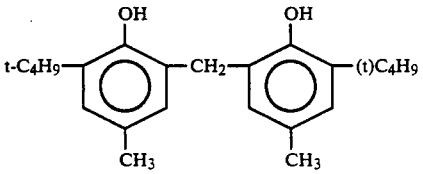

W-1

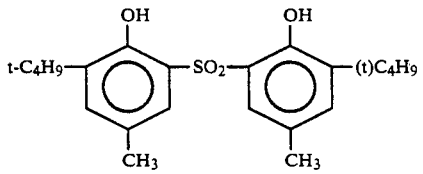

W-2

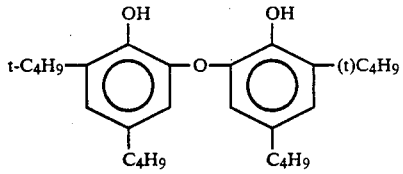

W-3

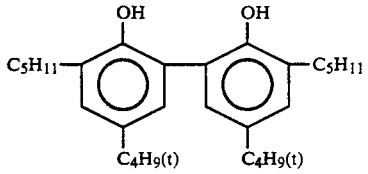

W-4

Having described our invention as related to the embodiment, it is our intention that the invention not be limited by any of the details of the description, unless otherwise specified, but rather be construed broadly within its spirit and scope as set out in the accompanying claims.

What we claim is:

1. A silver halide color photographic material having at least one silver halide emulsion layer on a base, which comprises, in said silver halide emulsion layer, at least one magenta coupler represented by the following formula (I):

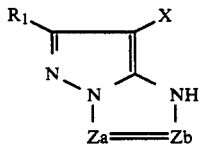

Formula (I)

wherein Za and Zb each represent

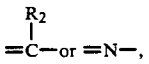

$R_1$ and $R_2$ each represent a hydrogen atom or a substituent, X represents a hydrogen atom or a group or an atom capable of being released upon the coupling reaction with the oxidized product of an aromatic primary amine developing-agent, when Za and Zb together form a carbon-carbon double bond, Za and Zb may be part of the aromatic ring, and the compound may form a dimer or higher polymer through $R_1$, $R_2$, or X, at least one compound represented by the following formula (II):

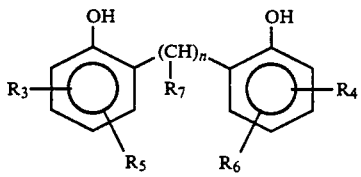

Formula (II)

wherein $R_3$ and $R_4$ are each a methyl group, $R_5$ and $R_6$ each represent an alkyl group having 1 to 18 carbon atoms, $R_7$ represents a hydrogen atom or an alkyl group have 3 to 12 carbon atoms, n is an integer of 1 to 3, and when n is 2 to 3, $R_7$ may be the same or different, and when n is 1, $R_7$ represents the above-mentioned alkyl group, and a high-boiling coupler solvent incompatible with water, and the weight ratio of said high-boiling coupler solvent to the coupler is 3.5 to 10.0.

2. The silver halide color photographic material as claimed in claim 1, wherein the silver halide emulsion layer contains at least one homopolymer or copolymer insoluble in water.

3. The silver halide color photographic material as claimed in claim 2, wherein the homopolymer or copolymer is a polymer being insoluble in water and having a good compatibility with the coupler and the dye formed.

4. The silver halide color photographic material as claimed in claim 2, wherein the homopolymer or copolymer is a polymer whose repeating units have

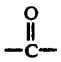

bonds.

5. The silver halide color photographic material as claimed in claim 2, wherein the ratio of the polymer to the coupler represented by formula (I) is 0.01:1 to 6:1 in weight ratio.

6. The silver halide color photographic material as claimed in claim 2, wherein the ratio of the polymer to the high-boiling organic solvent in the same layer is 0.001:1 to 2:1 in weight ratio.

7. The silver halide color photographic material as claimed in claim 1, wherein coupler represented by formula (I) is a compound represented by the following formula (Ia) or (Ib):

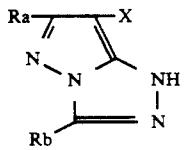

Formula (Ia)

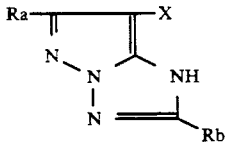

Formula (Ib)

wherein Ra and Rb each represent a hydrogen atom or a substituent, X represents a group capable of being released upon the coupling reaction with the oxidized product of an aromatic primary amine developing agent.

8. The silver halide color photographic material as claimed in claim 1, wherein $R_1$ and $R_2$ each are selected from the group consisting of a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group.

9. The silver halide color photographic material as claimed in claim 8, wherein $R_1$ and $R_2$ are each selected from the group consisting of an alkyl group, an alkoxy group, an alkylthio group, an aryl group, an aryloxy group, an arylthio group, an acylamino group, and an anilino group.

10. The silver halide color photographic material as claimed in claim 1, wherein X is selected from the group consisting of a hydrogen atom, a halogen atom, a carboxy group, a group capable of being released upon a coupling reaction that bonds to the carbon atom at the coupling site through an oxygen atom, a nitrogen atom, and a sulfur atom.

11. The silver halide color photographic material as claimed in claim 1, wherein the coupler represented by formula (I) is contained in the range of $1\times10^{-2}$ to 1 mol per mol of the silver halide.

12. The silver halide color photographic material as claimed in claim 1, wherein the coupler represented by formula (I) is used together with other types of magenta coupler.

13. The silver halide color photographic material as claimed in claim 1, wherein the compound represented by formula (II) is added 1 to 100 mol % to the coupler.

14. The silver halide color photographic material as claimed in claim 1, wherein the high-boiling coupler solvent has a boiling point of 140° C. or over.

15. The silver halide color photographic material as claimed in claim 1, wherein the high-boiling coupler solvent is selected from the group consisting of compounds represented by the following formula (III), (IV), (V), (VI), and (VII):

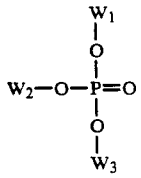

Formula (III)

$W_1-COO-W_2$ Formula (IV)

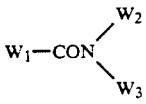

Formula (V)

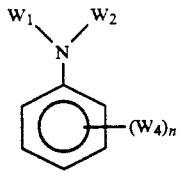

Formula (VI)

$W_1-O-W_2$ Formula (VII)

wherein $W_1$, $W_2$, and $W_3$ each represent a substituted or unsubstituted alkyl group, cycloalkyl group, alkenyl group, aryl group, phenyl group, or heterocyclic group, $W_4$ represents $W_1$, O—$W_1$ or S—$W_1$, n is an integer of 1 to 5, when n is 2 or over, $W_4$ groups may be the same or different, and in formula (VII), $W_1$ and $W_2$ may together form a condensed ring.

16. The silver halide color photographic material as claimed in claim 15, wherein the high boiling solvent for coupler is selected from the group consisting of compounds represented by formulas (III), (IV), and (V).

17. The silver halide color photographic material as claimed in claim 1, wherein an organic co-solvent is used with the high-boiling coupler solvent.

18. The silver halide color photographic material as claimed in claim 1, wherein a photographic hydrophobic substance is incorporated together with the compound of formula (II).

19. The silver halide color photographic material as claimed in claim 1, wherein the weight ratio of the high-boiling coupler solvent to the coupler is 3.5 to 5.0.

20. The silver halide color photographic material as claimed in claim 1, wherein the total number of carbon atoms of $R_3$ to $R_7$ in formula (II) is 6 or over.

21. The silver halide color photographic material as claimed in claim 1, wherein the total number of carbon atoms of $R_3$ to $R_7$ in formula (II) is 32 or over.

22. The silver halide color photographic material is claimed in claim 1, wherein $R_7$ in formula (II) is an alkyl group having 3 to 5 carbon atoms.

* * * * *